US009213270B2

(12) United States Patent
Sakuma et al.

(10) Patent No.: US 9,213,270 B2
(45) Date of Patent: Dec. 15, 2015

(54) IMAGE FORMING APPARATUS

(75) Inventors: Tetsushi Sakuma, Osaka (JP); Takeshi Sakashita, Hyogo (JP); Masanari Fujita, Osaka (JP); Mitsutoshi Kichise, Osaka (JP); Yuuji Meguro, Hyogo (JP); Masato Tsuji, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 55 days.

(21) Appl. No.: 13/597,025

(22) Filed: Aug. 28, 2012

(65) Prior Publication Data

US 2013/0051854 A1 Feb. 28, 2013

(30) Foreign Application Priority Data

Aug. 29, 2011 (JP) ..... 2011-186385
Aug. 29, 2011 (JP) ..... 2011-186389

(51) Int. Cl.
*G03G 15/14* (2006.01)
*G03G 15/16* (2006.01)

(52) U.S. Cl.
CPC ..... *G03G 15/1605* (2013.01); *G03G 15/1695* (2013.01)

(58) Field of Classification Search
CPC ..... G03G 15/1605; G03G 15/1695
USPC ..... 399/297, 302, 303, 306, 308, 317, 121
See application file for complete search history.

(56) References Cited

U.S. PATENT DOCUMENTS 5,245,394 A 9/1993 Ikeda et al.
5,983,062 A 11/1999 Sameshima
6,516,179 B1 2/2003 Sawai et al.
2005/0260015 A1* 11/2005 Ito ..... 399/316
2007/0008397 A1* 1/2007 Maebashi ..... 347/158
2007/0110458 A1 5/2007 Inoue et al.
2007/0183816 A1 8/2007 Hatayama et al.
2007/0269233 A1 11/2007 Sakashita et al.
2008/0003022 A1 1/2008 Sakashita et al.

(Continued)

FOREIGN PATENT DOCUMENTS

CN 1700119 A 11/2005
CN 101334620 A 12/2008

(Continued)

OTHER PUBLICATIONS

U.S. Appl. No. 13/421,532, filed Mar. 15, 2012, unpublished.

*Primary Examiner* — Benjamin Schmitt
*Assistant Examiner* — Matthew Miller
(74) *Attorney, Agent, or Firm* — Harness, Dickey & Pierce, P.L.C.

(57) ABSTRACT

An image forming apparatus includes: a rotatable transfer member rotatably driven while carrying a toner image thereon; a rotary transfer member to form a transfer nip for transferring the toner image to a recording medium; a housing rotatable about a first rotation center together with the rotary transfer member and switching between a closed state and an open state by the rotation about the first rotation center; a guide member to guide the recording medium conveyed through a conveyance path toward upstream in the direction of rotation of the rotatable transfer member than the transfer nip; a support frame to support the rotatable transfer member; a biasing member to bias the guide member; and a receiving part, disposed on the support frame, configured to contact the guide member biased by the biasing member and position the guide member in the closed state of the housing.

25 Claims, 18 Drawing Sheets

(56) References Cited

U.S. PATENT DOCUMENTS

| | | | | |
|---|---|---|---|---|
| 2008/0028967 | A1 | 2/2008 | Sakashita et al. | |
| 2008/0050158 | A1 | 2/2008 | Hatayama et al. | |
| 2008/0138133 | A1 | 6/2008 | Hatayama et al. | |
| 2008/0187365 | A1 | 8/2008 | Sakashita et al. | |
| 2008/0193167 | A1 | 8/2008 | Inoue et al. | |
| 2008/0193173 | A1 | 8/2008 | Meguro et al. | |
| 2008/0226358 | A1 | 9/2008 | Hanashima et al. | |
| 2008/0310893 | A1 | 12/2008 | Adachi et al. | |
| 2008/0316559 | A1 | 12/2008 | Nagaoka et al. | |
| 2008/0317521 | A1 | 12/2008 | Inoue et al. | |
| 2008/0317532 | A1* | 12/2008 | Ehara et al. | 399/400 |
| 2009/0011882 | A1 | 1/2009 | Kichise et al. | |
| 2009/0014288 | A1 | 1/2009 | Miyazaki et al. | |
| 2009/0016772 | A1 | 1/2009 | Adachi et al. | |
| 2009/0123201 | A1 | 5/2009 | Ehara et al. | |
| 2009/0129831 | A1 | 5/2009 | Sakashita et al. | |
| 2009/0162114 | A1* | 6/2009 | Nakura et al. | 399/308 |
| 2009/0285594 | A1 | 11/2009 | Kichise et al. | |
| 2010/0239334 | A1 | 9/2010 | Iwami et al. | |
| 2011/0110685 | A1 | 5/2011 | Sato et al. | |
| 2012/0057908 | A1 | 3/2012 | Meguro | |
| 2012/0114373 | A1 | 5/2012 | Hamada et al. | |
| 2013/0216260 | A1* | 8/2013 | Kogure et al. | 399/121 |

FOREIGN PATENT DOCUMENTS

| | | | |
|---|---|---|---|
| JP | 4-291362 | A | 10/1992 |
| JP | 5-257346 | A | 10/1993 |
| JP | 09240880 | | 9/1997 |
| JP | 2001-356538 | | 12/2001 |
| JP | 2001356619 | A | 12/2001 |
| JP | 2002040818 | A | 2/2002 |
| JP | 2002214943 | A | 7/2002 |
| JP | 2003-307944 | A | 10/2003 |
| JP | 2006-011044 | | 1/2006 |
| JP | 2006-248663 | A | 9/2006 |
| JP | 2006-301509 | | 11/2006 |
| JP | 2008-003447 | | 1/2008 |
| JP | 2008-026533 | | 2/2008 |
| JP | 2011-102860 | A | 5/2011 |

* cited by examiner

IMAGE FORMING APPARATUS

CROSS-REFERENCE TO RELATED APPLICATIONS

The present application claims priority from Japanese patent application numbers 2011-186389 and 2011-186385, both filed on Aug. 29, 2011, the entire contents of which are incorporated by reference herein.

BACKGROUND OF THE INVENTION

1. Field of the Invention

The present invention relates to an image forming apparatus.

2. Description of the Related Art

In general, an image forming apparatus using an electrophotographic method employs charged toner having a polarity to form a toner image on a surface of a photoreceptor, and transfers the toner image to an intermediate transfer belt as a primary transfer. Subsequently, the toner image on the intermediate transfer belt is secondarily transferred to a recording medium, where a fixing process fixes the image on the medium to form a final image. The intermediate transfer belt and a transfer roller form a secondary transfer nip in between. In performing the secondary transfer, by applying a transfer voltage having an opposite polarity to the charged polarity of the toner on the intermediate transfer belt to the transfer roller, a transfer electrical field is formed at the secondary transfer nip that transfers the toner image on the intermediate transfer belt en bloc to the recording medium.

As illustrated in FIG. 19, in the transfer device, in the vicinity of the transfer electrical field before the transfer process performed at the secondary transfer nip N formed by the intermediate transfer belt 100 and the transfer roller 200, a space M (i.e., an electrical discharge area) exists between the intermediate transfer belt 100 and a recording sheet P. In the space M, part of toner on the intermediate transfer belt 100 disperses due to discharging generated by the electrical field and the dispersed part of toner attaches to the recording sheet P, thereby causing the image on the recording sheet P to be disturbed. To prevent this, as illustrated in FIG. 20, a roller 300 is additionally disposed before the secondary transfer nip N to cause the intermediate transfer belt 100 and the recording sheet P to be closely attached to each other before the space M, thereby minimizing the effect of the electrical discharge. However, disposition of the roller 300 to change a route of the intermediate transfer belt 100 may cause a cost rise, and increase in the thickness of the transfer device due to the enlarged mounting space, which may cause the transfer device to be larger.

As another method to prevent the effect of the electrical discharge, for example, it is known that the provision of a guide before the transfer nip enables the recording medium P to closely attach to the intermediate transfer belt before the secondary transfer nip N. JP-2006-301509-A, JP-2008-026533-A, and JP-4038328-B disclose an image forming apparatus using this type of guide before the transfer nip. In addition, JP-4038328-B discloses provision of two guide members so as to keep a close contact between the image carrier and the transfer member, which increases the size of the apparatus.

Yet the conventional guide member before transfer has various problems such as distortion of the guide member due to interference with the transfer belt or other parts or components.

BRIEF SUMMARY OF THE INVENTION

In light of the above, the present invention provides an improved image forming apparatus including a guide member having a higher positional precision with respect to the transfer member. The image forming apparatus is compact, easy to maintain, and forms high-quality images.

More specifically, the present invention includes a transfer device rotatably driven while carrying a toner image thereon; a rotary transfer member to form a transfer nip for transferring the toner image on the transfer device to a recording medium; a housing rotatable about a first rotation center together with the rotary transfer member and capable of switching between a closed state to form the transfer nip and an open state eliminating the transfer nip by the rotating about the first rotation center; a guide member to guide the recording medium conveyed through a conveyance path toward upstream in the direction of rotation of the transfer device than the transfer nip, the guide member being supported by the housing; a support frame to support the transfer device; a biasing member to bias the guide member; and a receiving part, disposed on the support frame, configured to contact the guide member biased by the biasing member and position the guide member in the closed state of the housing. The image forming apparatus further includes a rotary sliding unit allowing a rotary movement about a second rotation center and a reciprocal slidable movement within a predetermined range.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Figure 1:
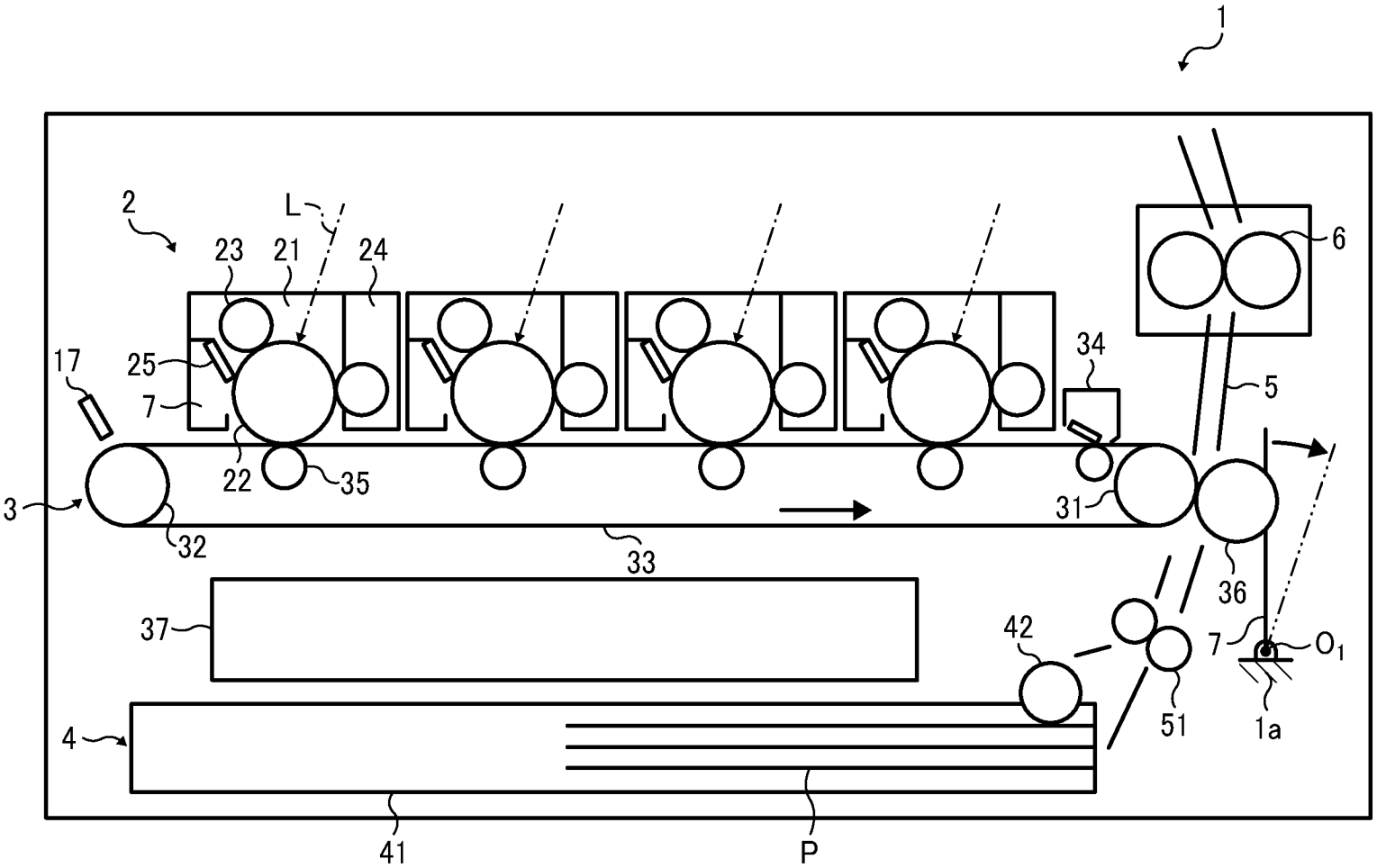
FIG. 1 is a cross-sectional view of an image forming apparatus according to an embodiment of the present invention.

Hereinafter, the present invention will now be described referring to accompanying drawings. FIG. 1 shows an image forming apparatus according to an embodiment of the present invention.

As illustrated in FIG. 1, the image forming apparatus 1 includes an exposure unit (not shown), an image forming unit 2, a transfer device 3, a sheet feed unit 4, a conveyance path 5, a fixing unit 5, and the like.

The exposure unit is disposed in an upper part of the image forming apparatus 1 and includes a power source to emit laser beams and various optical systems. Specifically, the exposure unit directs laser beams L for each color-decomposed component of an image which will be formed based on image data obtained from an image reading means, not shown, onto a photoreceptor drum 22 of the image forming unit 2, so that a surface of the photoreceptor drum 22 is exposed according to the image data.

The image forming unit 2 is disposed below the exposure unit and includes a plurality of process units 21, which are detachably attached to the image forming apparatus 1. Each process unit 21 includes the photoreceptor drum 22 capable of carrying toner as a developer on a surface thereof; a charging roller 23 to uniformly charge a surface of the photoreceptor drum 22; a developing device 24 to supply toner on the surface of the photoreceptor drum 22; and a cleaning blade 25 to clean the surface of the photoreceptor drum 22, and the like. The developing device 24 contains the toner initially having a negatively charged polarity. There are four process units 21 corresponding to different colors of yellow, cyan, magenta, and black, each being a color-decomposed component of a color image. Each process unit 21 has a same structure except that each includes a different color of toner such as yellow (y), magenta (m), cyan (c), and black (Bk), and therefore, reference numerals are omitted.

The transfer device 3 is disposed directly below the image forming unit 2. The transfer device 3 includes a drive roller 31 and a driven roller 32 both serving as a support member; a rotary intermediate transfer belt 33, a transfer member, rotatably stretched around the drive roller 31 and the driven roller 32; a belt cleaning unit 34 to clean a surface of the intermediate transfer belt 33; a primary transfer roller 35 formed of a metal material, disposed at a position opposed to the photoreceptor drum 22 of each process unit 21 with the intermediate transfer belt 33 sandwiched between; and the like. Each primary transfer roller 35 presses against an interior surface of the intermediate transfer belt 33 at each disposed position and a primary transfer nip is formed at a position where the pressed portion of the intermediate transfer belt 22 contacts each photoreceptor drum 22. It is to be noted that the an example using the metallic primary transfer roller 35 as a primary transfer member is shown, but a conductive blade or a conductive sponge roller may also be used as a primary transfer member. The driven roller 32 is biased, by a compression spring (not shown), against the intermediate transfer belt 33 in such a direction to give a tension to the intermediate transfer belt 33.

The drive roller 31 may be formed of polyurethane rubber (with a thickness of 0.3 to 1 mm) or a thin-layer coating roller (with a thickness of 0.03 to 0.1 mm). In addition, the driven roller 32 is formed of aluminum with a press-fitted flange, not shown, to regulate wobbling of the intermediate transfer belt 33.

The intermediate transfer belt 33 is an endless belt formed of a resin film in which a conductive material is dispersed. Examples of resin films include vinylidene fluoride (PVDF), ethylene-4-ethylene fluoride copolymers (ETFE), polyimide (PI), polycarbonate (PC), thermally plastic elastomer (TPE), and the like. In the present embodiment, a belt with a coefficient of elasticity of 1000 to 2000 Mpa, a thickness of 90 to 160 μm and a width of 230 mm is used.

The intermediate transfer belt 33 preferably has a volume resistivity of $10^8$ to $10^{11}$ Ω*cm and a surface resistivity of $10^8$ to $10^{11}$ Ω/sq under an environment of 23° C. and 50% RH.

If the volume resistivity and the surface resistivity of the intermediate transfer belt 33 exceed the above described ranges, the intermediate transfer belt 33 acquires an electrical charge, which requires an additional process to set the voltage value downstream in the image forming process higher. Accordingly, it becomes impossible to use a single power supply to the primary transfer unit. This is because, due to the electrical discharge that occurs in the transfer process or the transfer medium separation process, the electrical potential of the surface of the intermediate transfer belt 33 becomes high and the self-discharge from the surface of the intermediate transfer belt 33 becomes impossible.

If the volume resistivity and the surface resistivity are below the above defined ranges, the decrease of the charged potential starts earlier, which is favorable to the self-discharge, but because the current in the transfer process flows over a surface of the photoreceptor, toner dispersion may occur.

In the downstream of the lowermost process unit 21, a specular-type or diffusion-type toner mark sensor 17 (TM sensor) is disposed. In performing adjustment of the image density or color alignment, the sensor 17 measures density of the toner image or position of each color on the intermediate transfer belt 33.

The secondary transfer roller 36 as a rotary transfer member is disposed at a position opposed to the drive roller 31 via the intermediate transfer belt 36. The secondary transfer roller 36 presses against an external surface of the intermediate transfer belt 33 and a secondary transfer nip is formed at a position where the secondary transfer roller 36 contacts the intermediate transfer belt 33 around which the secondary transfer roller 26 and the drive roller 31 are stretched. The secondary transfer roller 36 includes a metal core formed of a metal such as SUS, which is coated by an elastic member such as urethane with an adjusted resistivity of from $10^6$ to $10^{10}$Ω. Examples of elastic materials include ion-conductive roller (formed of urethane with dispersed carbon, NBR, or hydrin)

or electroconductive type roller (formed of EPDM). In the present invention, a roller with Asker C hardness from 35 to 50 may be used.

If the resistivity of the secondary transfer roller 36 exceeds the above range, because the current does not flow easily, a higher voltage needs to be applied to achieve a necessary transferability, thereby increasing the power supply cost. Further, because the higher voltage needs to be applied, electrical discharge tends to occur in the spaces around the secondary transfer nip, thereby degrading the image quality. Such image degrading becomes noticeable in low-temperature and low-humidity environments (e.g., 10° C. and 15% RH).

In contrast, if the resistivity of the secondary transfer roller 36 is below the defined range, transferability between the image formed of multicolor (e.g., three-color superposed image) and the monochrome image existing in the same image cannot be ensured. This is because resistivity of the secondary transfer roller 36 is small, and therefore enough current flows to transfer the monochrome image at a relatively low voltage. However, because a higher voltage than the voltage appropriate to transfer the monochrome image is required to transfer the multi-color image, if the voltage is set at the multicolor image transferable voltage, an excessive transfer current flows for the monochrome image, thereby reducing the transferring efficiency.

The above resistivity values are obtained as follows: 1) the roller 36 is placed on a conductive metal plate, 2) a load of 4.9 N is applied to each of both ends of the metal core, 3) voltage of 1 kV is applied between the metal core and the metal plate, and 4) current value is calculated.

Below the intermediate transfer belt 33, a waste toner container 37 is disposed to contain the waste toner which is removed by the belt cleaning unit 34 and conveyed via a waste toner conveying hose, not shown.

The sheet feed unit 4 is disposed at a bottom of the image forming apparatus 1 and includes a sheet feed tray 41 containing a recording sheet P as a recording medium and a sheet feed roller 42 to feed the recording sheet P from the sheet feed tray 41.

The conveyance path 5 is a path through which the recording sheet P fed out of the sheet feed unit 4 is conveyed and a pair of registration rollers 51, a conveyance roller pair, not shown, up to an ejection portion which will be described later are arbitrarily disposed along the conveyance path 5.

The fixing unit 6 is disposed downstream in the conveyance path of the secondary transfer nip and includes a fixing roller heated by a heat source, not shown, a pressure roller capable of pressing the fixing roller, and the like.

The ejection portion, not shown, is disposed most downstream of the conveyance path 5 of the image forming apparatus 1, and includes a pair of sheet ejection rollers to eject the recording sheet P outside and a sheet ejection tray to stock the ejected sheet.

Next, a basic operation of the image forming apparatus 1 will now be described with reference to FIG. 1.

When an image forming operation is started, each photoreceptor 22 of each process unit 21 is driven to rotate in the clockwise direction as illustrated in FIG. 1 at a cyclic speed of 100 to 180 mm/s, and each surface of the photoreceptor 22 is uniformly charged to a predetermined polarity and surface potential of, for example, −200V to −1000V by the charging roller 23. The charged surface of each photoreceptor drum 22 is irradiated the laser beams L for each color component of the target image from the exposure unit, thereby creating an electrostatic latent image thereon. In this case, the image data exposed on each photoreceptor 22 is monochrome image data decomposed, from the target full-color image, into color data of yellow, magenta, cyan, and black. Each developing device 24 supplies toner to the electrostatic latent image thus formed on each photoreceptor 22, and the electrostatic latent image is rendered visible as a toner image or a developer image.

Successively, when the drive roller 31 of the transfer device 3 rotates in the counterclockwise direction as shown in FIG. 1, the intermediate transfer belt 33 is driven to rotate in a direction as indicated by an arrow in FIG. 1. In addition, with a constant voltage or constant-current controlled voltage (e.g., +500 to +1000V) having the polarity opposite to that of the charged toner is applied to each primary transfer roller 35. Accordingly, a transfer electrical field is formed at a primary transfer nip between each primary transfer roller 35 and each photoreceptor drum 22. The toner image of each color formed on each photoreceptor drum 22 of each process unit 21 is sequentially transferred in a superposed manner on the intermediate transfer belt 33 by the transfer electrical field formed in the primary transfer nip. With the operation above, a full-color toner image is formed on the surface of the intermediate transfer belt 33.

Thereafter, the toner remaining on each surface of the photoreceptor drum 22 after transferring the toner image is removed by the cleaning blade 25. Thereafter, the photoreceptor drum surface is subjected to a discharging operation by a discharger, not shown, the surface potential is initialized, and then, a next image forming is to be performed.

When an image forming operation is started, the sheet feed roller 42 of the sheet feed unit 4 is driven to rotate, so that the recording sheet P contained in the sheet feed tray 41 is fed out to the conveyance path 5. The recording sheet P is conveyed to the secondary transfer nip between the secondary transfer roller 36 and the drive roller 31 opposed to the secondary transfer roller 36 at a matched timing obtained by the registration rollers 51. In this case, because the transfer voltage having a polarity opposite to that of the charged toner of the toner image on the intermediate transfer belt 33 is applied to the secondary transfer roller 36, a transfer electrical field is formed at the secondary transfer nip. Through the electrical field formed at the secondary transfer nip, the toner image on the intermediate transfer belt 33 is transferred en bloc to the recording sheet P.

Next, the recording sheet P on which a toner image has been transferred is conveyed to the fixing unit 6, the recording sheet P is heated and pressed by the heated fixing roller and the pressure roller, and the toner image is fixed onto the recording sheet P. Thereafter, the recording sheet P is separated from the fixing roller, is conveyed by a pair of conveyance rollers, not shown, to the ejection portion, and is ejected by the sheet ejection roller to the sheet ejection tray. In addition, the remaining toner attached on the intermediate transfer belt 33 after transferring process is removed by the belt cleaning unit 34, is conveyed via a screw and a waste toner conveying hose, both not shown, to the waste toner container 37 and is collected therein.

Referring to FIGS. 1 through 7A and 7B, a detailed description will be given of the image forming apparatus 1 according to the present embodiment. FIGS. 2A and 2B each are a side view illustrating a general structure of a part around the secondary transfer nip in the image forming apparatus 1.

Figure 2A:
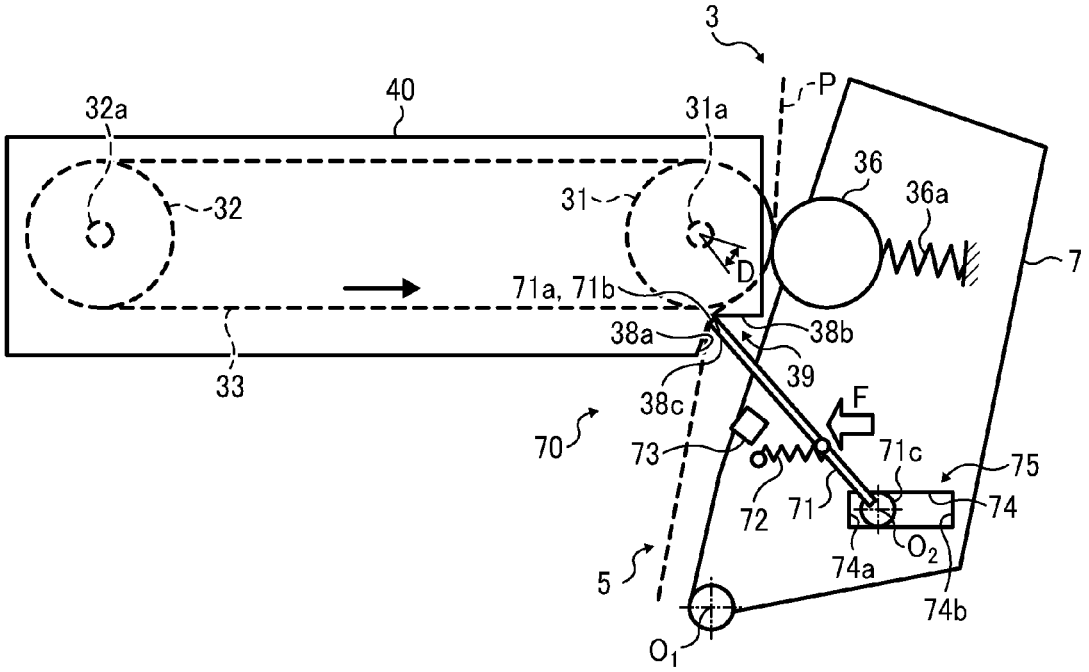
FIGS. 2A and 2B each show a general structure of a guide member with a housing and a transfer device according to an embodiment of the present invention.
Figure 2B:
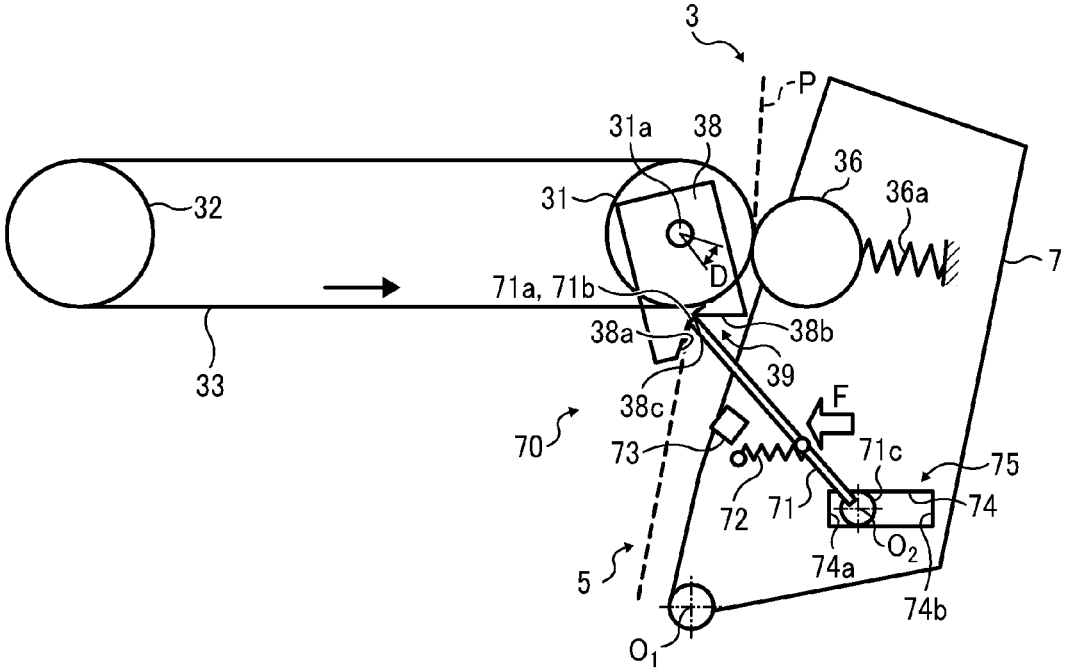

As illustrated in FIGS. 2A and 2B, the secondary transfer roller 36 to form the secondary transfer nip is rotatably supported to a housing 7. A spring 36*a* (e.g., a compression spring) configured to press the secondary transfer roller 36 against the drive roller 31 to obtain a predetermined nip pressure is disposed between the housing 7 and the secondary transfer roller 36.

As illustrated in FIG. 1, the housing 7 is disposed to cover a side of the conveyance path 5 and rotatably attached to a member 1*a* of a stationary side (for example, a base frame) attached to the apparatus body so as to rotate about a first rotary center $O_1$. During maintenance such as removal of a jammed sheet, a cover, not shown, of an external case of the image forming apparatus 1 is opened, the housing 7 is further rotated in direction of the arrow, and the side space of the conveyance path 5 is released. With this structure, the recording sheet P jamming and remaining in the conveyance path 5 is easily removed from outside.

Thus, when the housing 7 is rotated in the direction of the arrow, the secondary transfer roller 36, following the rotation of the housing 7, moves in a backward direction from the drive roller 31 and the secondary transfer nip is eliminated. On the other hand, after the maintenance, when the housing 7 is rotated in an inverse direction to that shown by the arrow, the secondary transfer roller 36 is disposed at a position contacting the intermediate transfer belt 33, thereby forming the secondary transfer nip.

In the description below, a state in which the housing 7 is closed and the secondary transfer nip is formed is referred to as a closed state of the housing (shown by a solid line in FIG. 1), and a state in which the housing 7 is opened and the secondary transfer nip is eliminated is called an open state of the housing (shown by a broken line in FIG. 1).

As illustrated in FIG. 2A and FIG. 2B, a guide unit 70 to guide the recording sheet P to be conveyed via the conveyance path 5 is disposed around the secondary transfer nip. The guide unit 70 includes a guide member 71 to guide the recording sheet P in the conveyance direction at an upstream of the secondary transfer nip in the sheet conveyance direction, a receiving part 39 to adjust positioning of the guide member 71, and a biasing spring 72 to bias the guide member 71 as a biasing means. The guide unit 70 according to the present embodiment includes a stopper 73 capable of contacting the guide member 71, and a rotary sliding unit 75 which allows a rotary movement and a back-and-forth sliding movement between the guide member 71 and the housing 71 relatively.

The guide member 71 has a width larger than that of the maximum-sized recording sheet P among the recording sheet P to be used. The guide member 71 is formed of resins, for example. Alternatively, the guide member 71 can be formed of any metal such as stainless steel (SUS).

Figure 3A:
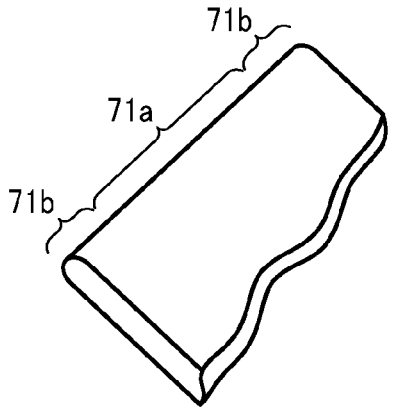
FIG. 3A shows an oblique view of the guide member.

As illustrated in FIG. 3A, at one end of the guide member 71, a guide portion 71*a* to guide the recording sheet P is formed at a central portion of the axis direction thereof. (The axis direction means a direction the first rotary center $O_1$ extends, which is applied to the description below.) Contact portions 71*b* to contact the receiving portion 39 or the positioning member 38 (See FIG. 2B) are disposed at both lateral ends of the axial direction of the guide member 71. To prevent butting of the front head of the contact portion 71*b* with the receiving part 39 in contacting operation, at least the front surface of the contact portion 71*b* is formed into a curved surface (or a cylindrical surface). A support shaft 71*c* protruding in the shaft direction is formed at another end of the guide member 71.

The biasing spring 72 is disposed between the housing 7 and the guide member 71. In FIGS. 2A and 2B, the biasing spring 72 is kept in the tension state and one end of the biasing spring 72 is connected at a part between the contact portion 71*b* of the guide member 71 and the support shaft 71*c*. With this structure, a biasing force F as illustrated by an arrow in FIGS. 2A and 2B is constantly applied. With this biasing force F, the guide member 71 is pressed to a contact portion with the receiving part 39 (or the positioning member 38). The biasing force F is preferably exerted in a direction parallel to a slidable moving direction allowed between the housing 7 and the guide member 71 in the rotary sliding unit 75, which will be described later.

The biasing force F should only be a rotation moment in the direction to rotate the guide member 71 about the one end of the guide member 71. So long as such a rotation moment is given to the guide member 71, the biasing spring 72 can be disposed at any arbitrary position. In addition, the biasing force F can be achieved by use of the spring in the compressed state as the biasing spring 72. Alternatively, the biasing force F can be achieved by use of an arbitrary elastic member other than the spring.

As illustrated in FIG. 2A, the receiving part 39 is integrated into a support frame 40 configured to rotatably support the drive roller 31 and the driven roller 32. The receiving part 39 in FIG. 2A includes a V-shaped partial cutout at a surface opposite the housing 7. The support frame 40 is formed from resins by injection molding and the receiving part 39 is formed by injection molding at the same time. The support frame 40 is attached to a stationary member (such as a base frame) of the apparatus body and disposed at both sides in the shaft direction of the drive roller 31 and the driven roller 32. The drive roller 31 and the driven roller 32 are sandwiched between the support frame 40. At both ends of the support frame 40 in the belt conveyance direction, each of the rotary shaft 31*a* and 32*b* of the drive roller 31 and the driven roller 32 is rotatably supported via a shaft bearing such as a roller bearing, not shown.

The receiving part 39 includes two guide surfaces 38*a* and 38*b*, both of which guide the contact portion 71*b* of the guide member 71. One guide surface 38*a* (the first guide surface) of the receiving part 39 extends in a direction intersecting the direction of the biasing force F and another guide surface 38*b* (the second guide surface) extends in a direction substantially parallel to the direction of the biasing force F. Both guide surfaces 38*a* and 38*b* are flat. A corner connecting the two guide surfaces 38*a* and 38*b* functions as a positioning part 38*c* so as to position the guide member 71. On the other hand, the positioning member 38 as illustrated in FIG. 2B is disposed at both sides in the shaft direction of the drive roller 31 with the drive roller 31 sandwiched between, so that the contact portion 71*b* of the guide member 71 may contact the positioning member 38.

The positioning member 38 has a plate shape formed of a metal material similar to the guide member 71 (such as stainless steel) and is fixed to the stationary member supporting a drive shaft 31*a* of the drive roller 31. Similarly, the positioning member 38 in FIG. 2B includes a V-shaped receiving part 39 formed of two guide surfaces 38*a* and 38*b* both of which guide the contact portion 71*b* of the guide member 71. One guide surface 38*a* (the first guide surface) of the receiving part 39 extends in a direction intersecting the direction of the biasing force F and another guide surface 38*b* (the second guide surface) extends in a direction substantially parallel to the direction of the biasing force F. Both guide surfaces 38*a* and 38*b* are formed to have a flat surface. A corner connecting the two guide surfaces 38*a* and 38*b* functions as a positioning part 38*c* so as to position the guide member 71.

Figure 3B:
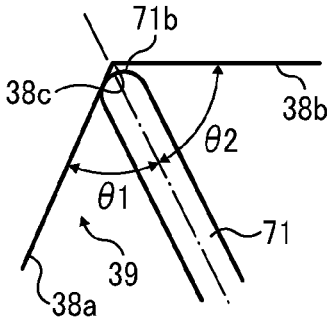
FIG. 3B is an enlarged side view of a part where the guide member and a receiving member contact.

In a closed state of the housing 7 as illustrated in FIGS. 2A and 2B, the contact portion 71*b* of the guide member 71 contacts the positioning part 38*c* of the receiving part 39 and the contacting state is held against the biasing force of the biasing spring 72. With this structure, a positioning of the guide member 71 is performed. As illustrated in FIG. 3B, in the state the positioning is performed, both angles θ1 and θ2 formed between the guide member 71 and two guide surfaces 38*a* and 38*b* of the receiving part 39 are acute. The crossed angle θ1+θ2 formed by the two guide surfaces 38*a* and 38*b* should be obtuse.

As illustrated in FIGS. 2A and 2B, the guide portion 71*a* of the guide member 71 is disposed upstream in the direction of rotation of the intermediate transfer belt 33 than the starting point of the secondary transfer nip and disposed with a predetermined interval with a peripheral surface of the intermediate transfer belt 33. As a result, the recording medium P conveyed through the conveyance path 5 first contacts the guide member 71, is guided by the guide portion 71*a*, and contacts the peripheral surface of the intermediate transfer belt 33 at upstream in the direction of rotation of the intermediate transfer belt 33 than the starting point of the secondary transfer nip.

The stopper 73 is fixed to the housing 7 at an area in which the biasing force F is acted than the guide member 71. As illustrated in FIGS. 2A and 2B, in a state in which the housing 7 is closed and the guide member 71 is positioned at the positioning part 38*c*, the stopper 73 is not contacted to the guide member 71.

The rotary sliding unit 75 is formed such that the support shaft 71*c* of the guide member 71 is slidably engaged with a slot 74 formed in the housing 7. With this structure, the guide member 71 is rotatable about the support shaft 71*c* with respect to the housing 7 and a rotation center $O_2$ (as a second rotation center) of the support shaft 71*c* becomes slidable back and force within a predetermined range S with respect to the housing 7.

Figure 3C:
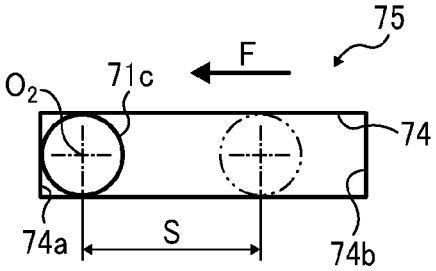
FIG. 3C is an enlarged view of a rotary sliding unit.
Figure 4A:
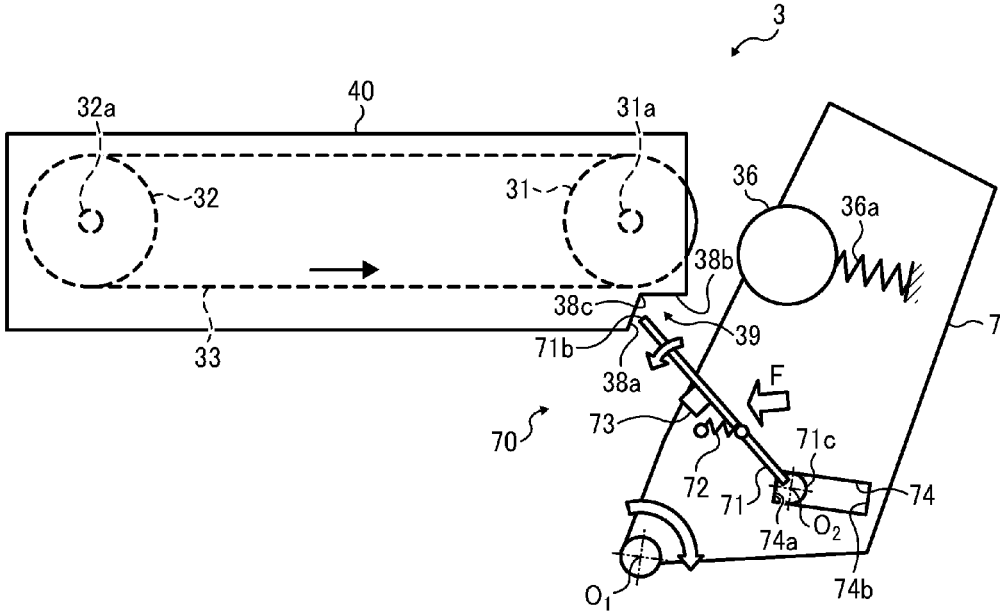
FIGS. 4A and 4B each are a side view illustrating the guide member in the housing moving from a closed state to an open state.
Figure 4B:
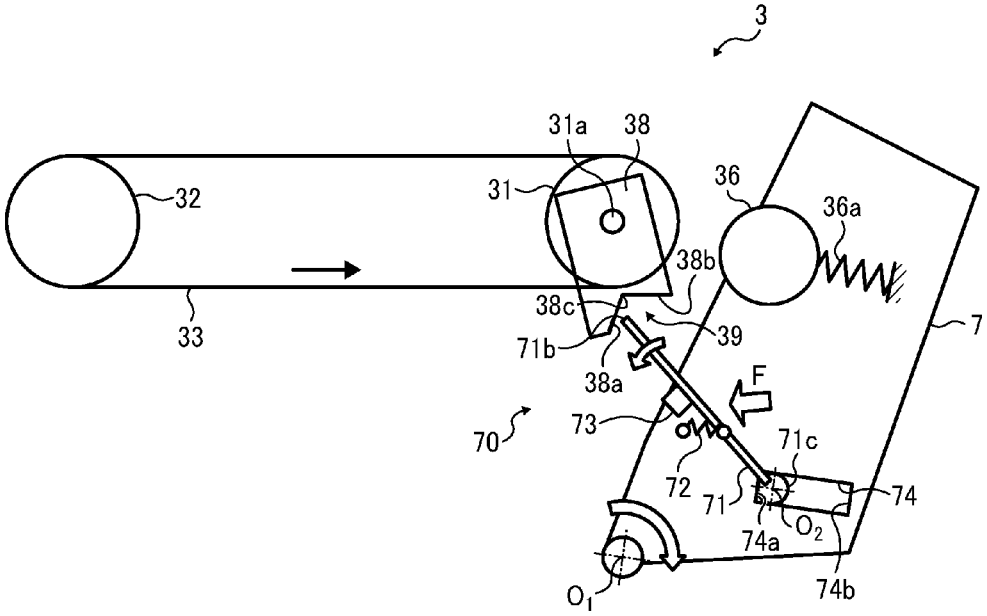

As illustrated in FIG. 3C, one end of the slidable range S is a position where the support shaft 71*c* (shown by a solid line) contacts one edge of the slot 74 existing in a direction of action of the biasing force F. On the other hand, at the other end of the slidable range S, the support shaft 71*c* (shown by a broken line) is made non-contact to the other edge 74*b* of the slot 74. As illustrated in FIGS. 2A and 2B, in the closed state of the housing 7, each part of the guide unit 70 is configured such that the second rotation center $O_2$ is positioned within the range S (that is, the support shaft 71*c* is in the non-contact state to both edges 74*a* and 74*b* of the slot 74).

The structure of the rotary sliding unit 75 is not limited to the structure as exemplified in FIGS. 2A and 2B, but any structure can be adopted so long as a relative rotational and slidable movement between the guide member 71 and the housing 7 is allowed. For example, contrary to the above embodiment, a part corresponding to the support shaft 71*c* can be disposed on the housing 7 and a part corresponding to the slot 74 can be disposed on the guide member 71. In addition, a construction in which a guide rail and a member sliding along the guide rail are disposed and one end of the guide member 71 is rotatably attached to the sliding member can be adopted. It is preferred that the range S be disposed linearly as illustrated in the drawings, but may be formed into a curve by configuring the slot 74 to be in a curved shape so long as the slidable movement can be smoothly performed. To enable a smooth slidable movement, no step is formed in the range S.

Hereinafter, an operation of the guide unit 70 will now be described with reference to FIGS. 2A and 2B through 7A and 7B.

When the housing 7 is opened from the state of FIGS. 2A and 2B, rotating about the first rotation center $O_1$, the secondary transfer roller 36 and the compression spring 36*a* move to a direction separating from the conveyance path 5 accompanying the housing 7.

With this operation, the guide member 71 rotates in the counterclockwise direction about the second rotation center $O_2$ by the biasing force F of the biasing spring 72 and abuts the stopper 73. By the similar biasing force F, the entire guide member 71 slidably moves in the direction of the action of the biasing force F, the support shaft 71*c* contacts one edge 74*a* of the slot 74, and second rotation center $O_2$ reaches one end of the range S. In this case, the contact portion 71*b* of the guide member 71 slidably moves downward on the first guide surface 38*a* of the receiving part 39.

When the housing 7 is moved to further open, the contact portion 71*b* of the guide member 71 is separated from the first guide surface 38*a*. When the housing 7 is further opened, the guide member 71 contacts the stopper 73 and in a state in which the second rotation center $O_2$ is remained at the end of the slidable range S, the housing 7 becomes an open state as illustrated in FIGS. 5A and 5B.

Figure 5A:
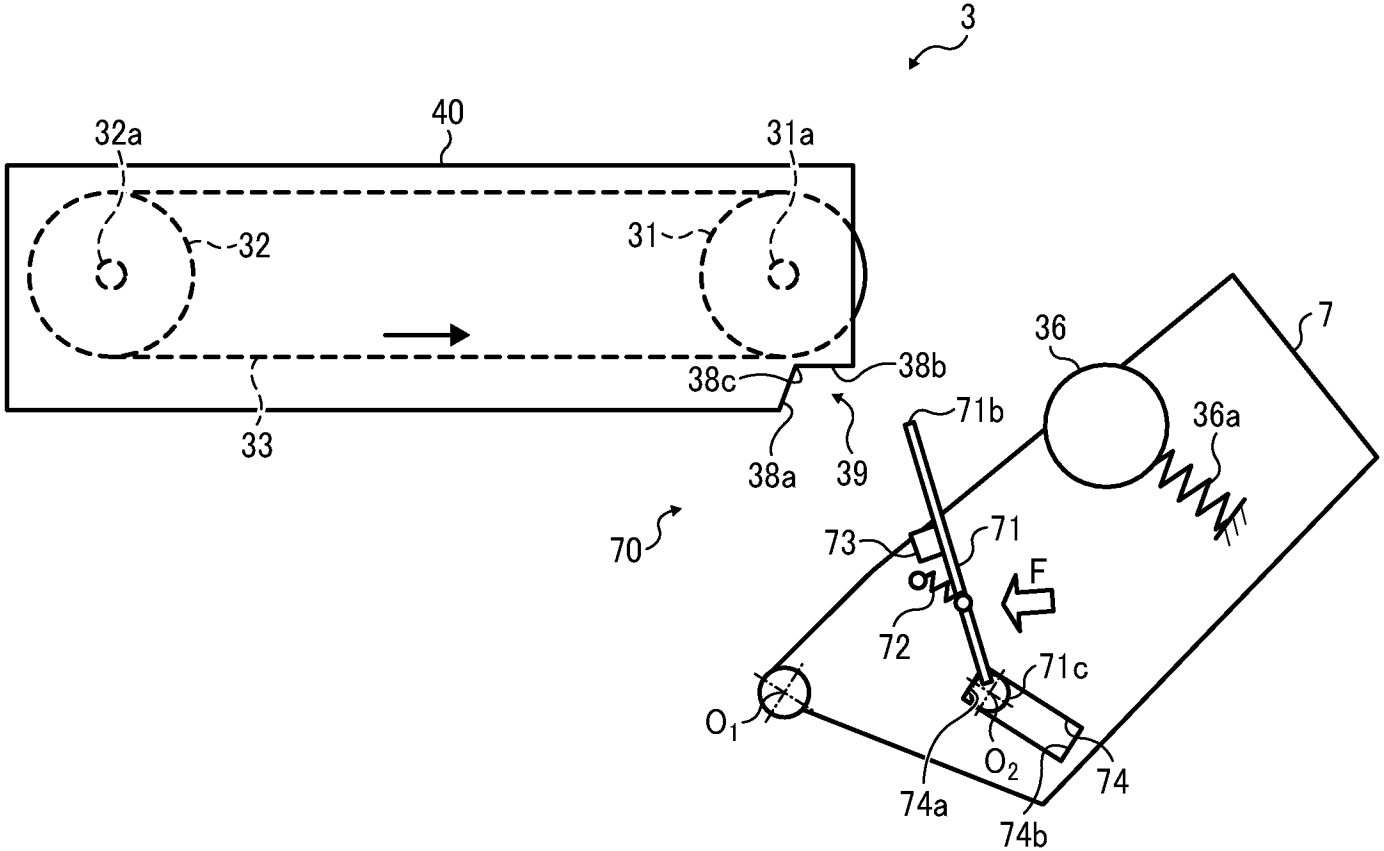
FIGS. 5A and 5B each are a side view illustrating the guide member in the housing open state.
Figure 5B:
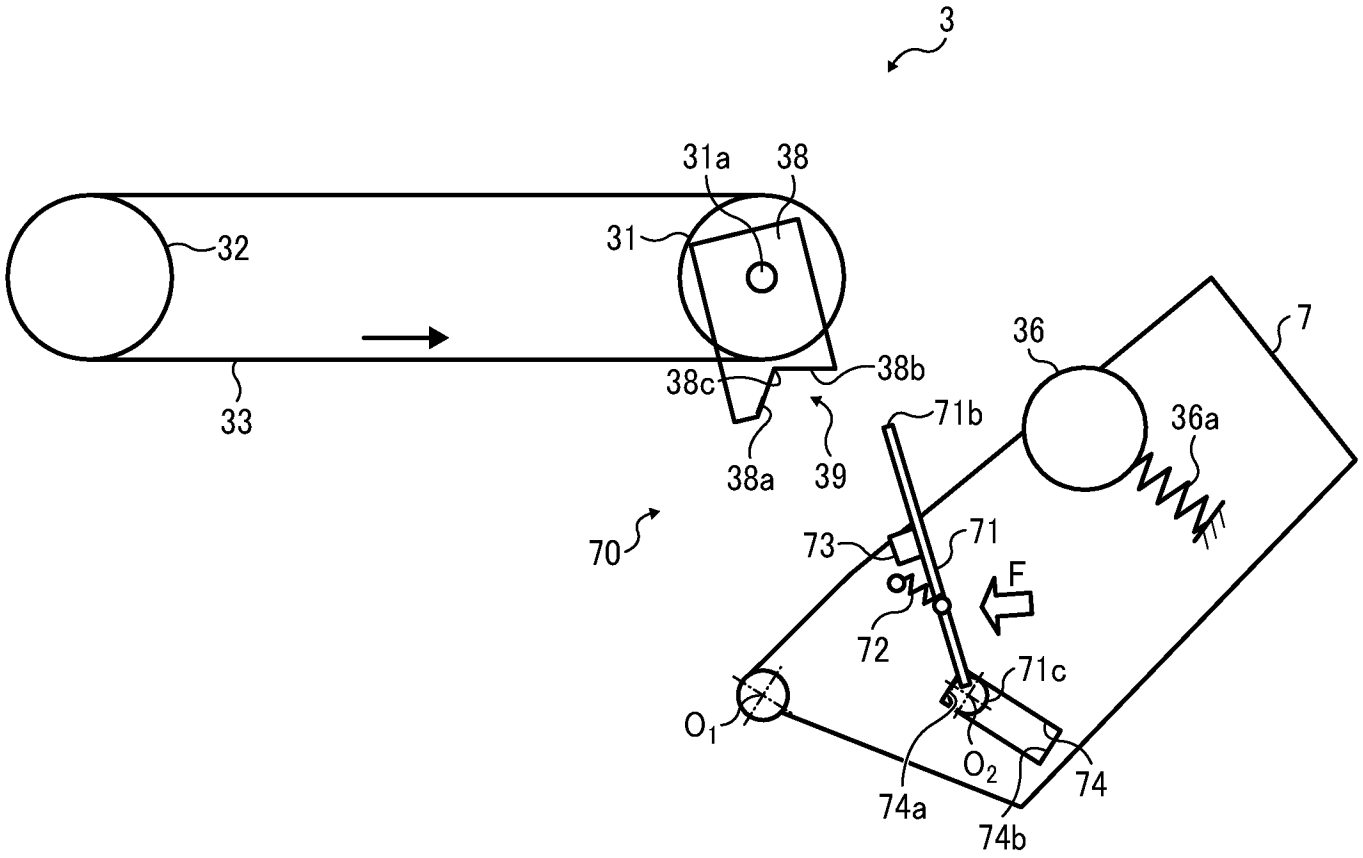
Figure 6A:
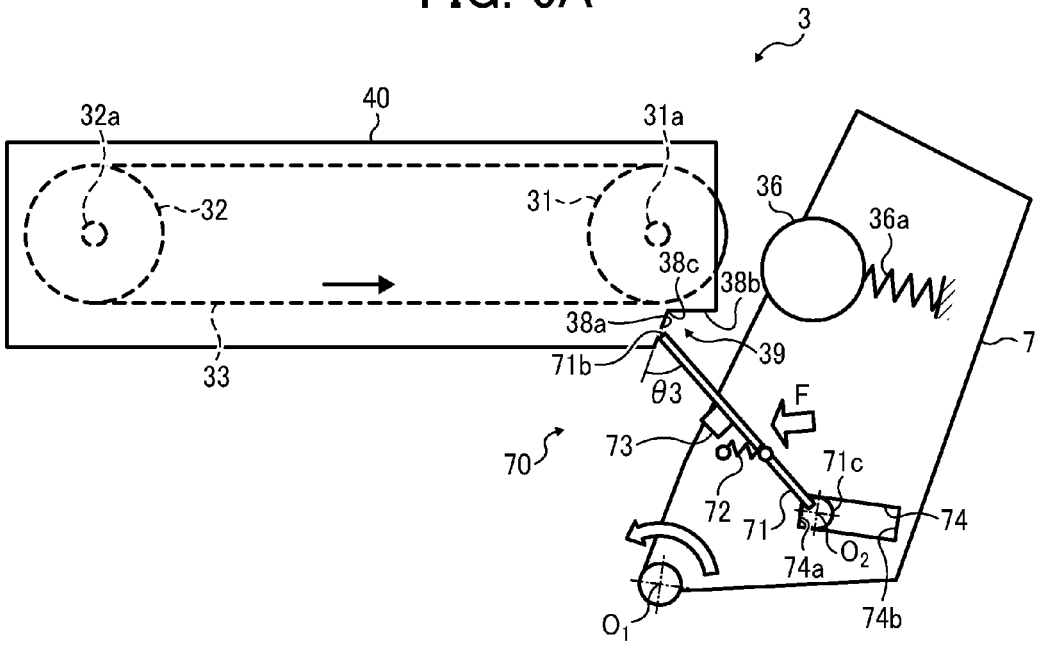
FIGS. 6A and 6B each are a side view illustrating the guide member in the housing moving from an open state to a closed state.
Figure 6B:
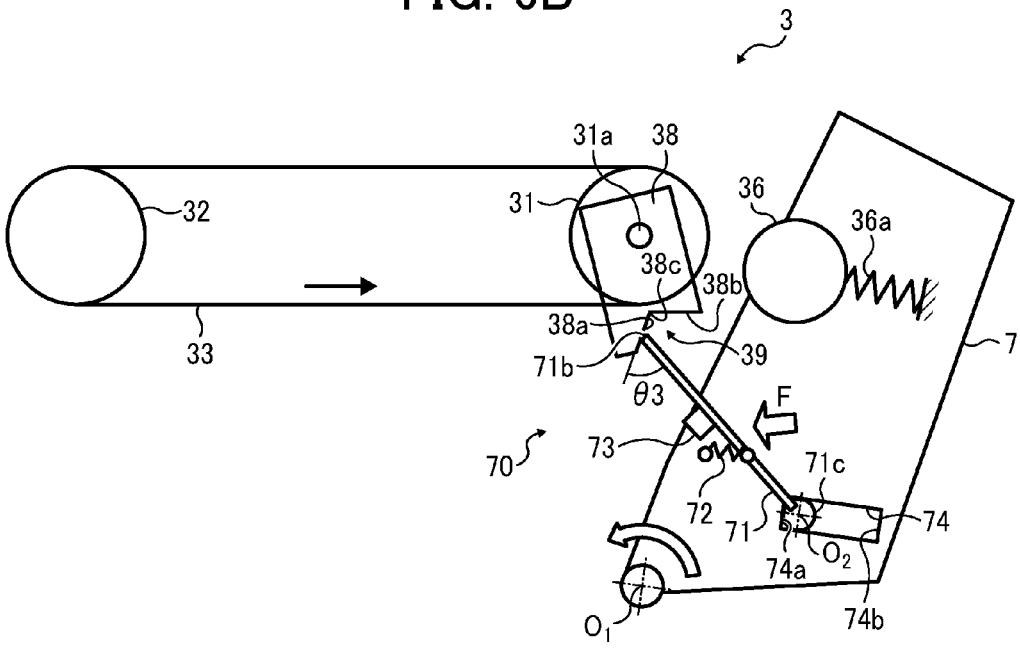

After maintenance, when the housing 7 is closed from the state as illustrated in FIGS. 5A and 5B, the contact portion 71*b* of the guide member 71 contacts the first guide surface 38*a* of the receiving part 39 (or the positioning member 38) as illustrated in FIGS. 6A and 6B. In this case, the angle θ3 of the guide member 71 formed with the first guide surface 38*a* is an acute angle. When the housing 7 is closed, the contact portion 71*b* of the guide member 71 slidably moves upward along the first guide surface 38*a*. In addition, the guide member 71 rotates in the clockwise direction about the second rotation center $O_2$ by the biasing force F of the biasing spring 72 and is separated from the stopper 73.

Figure 7A:
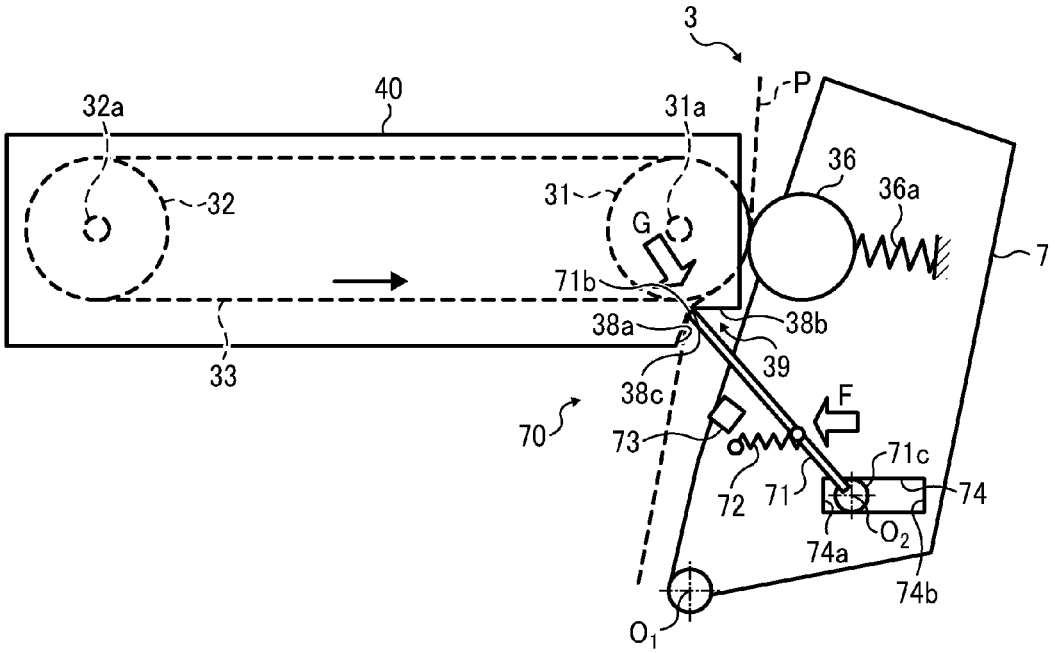
FIGS. 7A and 7B each are a side view illustrating the guide member in the housing closed state.
Figure 7B:
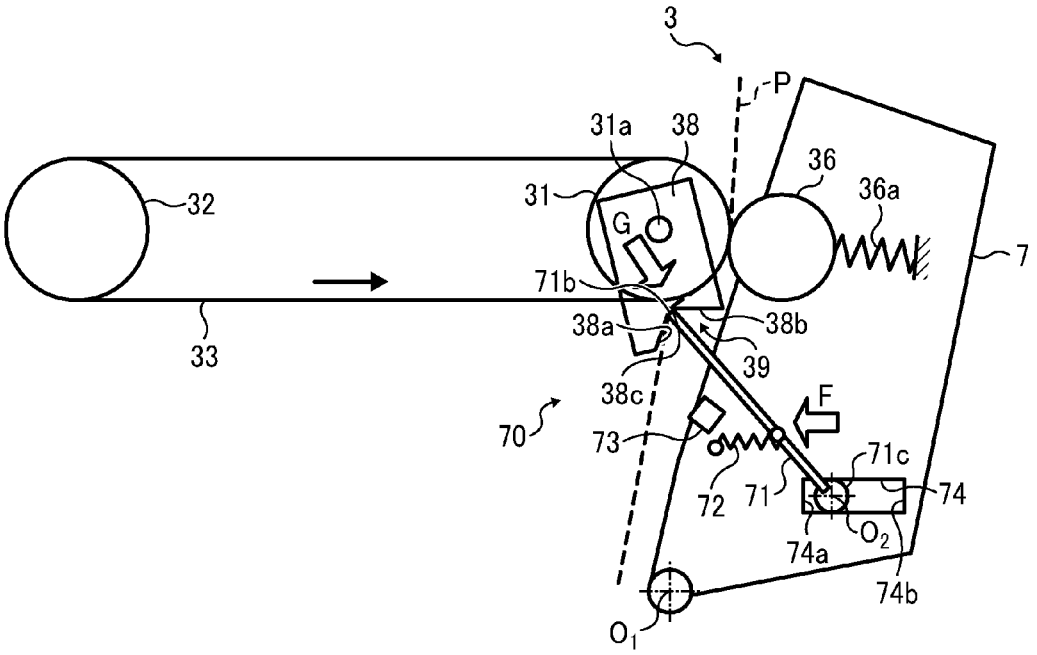

Thereafter, when the contact portion 71*b* of the guide member 71 reaches the positioning part 38*c* of the receiving part 39, the guide member 71 is held at the positioning part 38*c*. When the housing 7 is closed completely to form a closed state, as illustrated in FIGS. 7A and 7B, a stress G is exerted from the receiving part 39 to the guide member 71. This stress G slidably moves the support shaft 71*c* in a direction separating from the end 74*a* of the slot 74 and the moving of the support shaft 71*c* stops when the stress G becomes zero. At this time, the second rotation center $O_2$ is within the range S. With this structure, the closed state of the housing 7 as illustrated in FIGS. 2A and 2B is reproduced.

Figure 20:
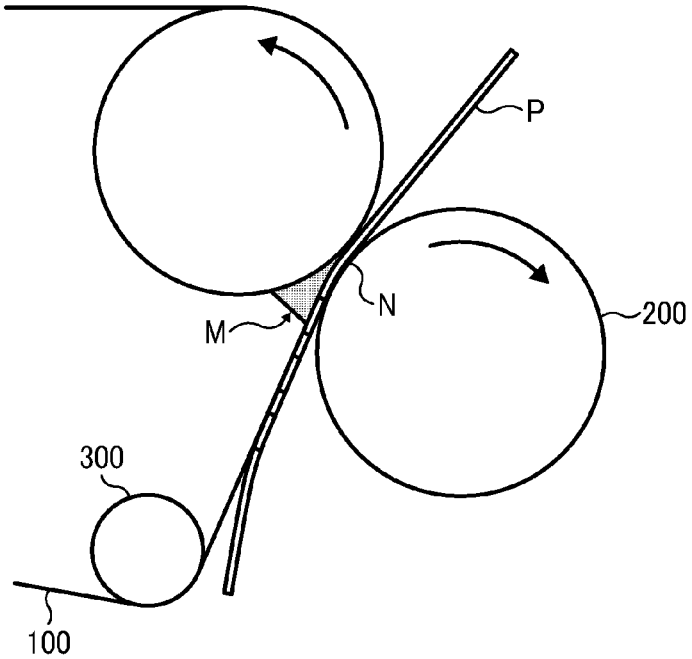
FIG. 20 RELATED ART
FIG. 20 is a side view of a conventional transfer device illustrating a general configuration thereof.

According to the guide unit 70 as described heretofore, because the recording medium P is guided by the guide member 71 at an upstream of the direction of rotation of the intermediate transfer belt 33 than the secondary transfer nip, formation of the space (serving as an electrical discharge area) between the intermediate transfer belt 33 and the recording sheet P near the secondary transfer electrical field is prevented. Thus, there is no need of adding a roller at an upstream in the belt direction of rotation than the drive roller 31 for the purpose of eliminating the electrical discharge area, and while achieving a more compact transfer device than the transfer device 3 as illustrated in FIG. 20, the image quality can be improved.

In addition, because the guide member 71 is supported by the housing 7, the guide member 71 is moved following the opening and closing of the housing 7. With this structure, the guide member 71 can be evacuated from the periphery of the conveyance path 5 of the recording sheet P in the open state of the housing 7. Therefore, when the recording sheet P clogging and remaining in the conveyance path 5 is removed therefrom, an interference of the sheet with the guide member 71 can be prevented, thereby improving the workability in the maintenance work.

When the receiving part 39 is formed as a member separated from the support frame 40 as illustrated in FIGS. 2B, 4B, 5B, 6B, 7B, 9B, 10B, and 12B and is configured to be attached to the support frame 40 or any other member, precision in mounting the receiving part 39 may affect the positional precision of the guide member 71. In this case, cumulative errors may reduce the positional precision of the guide member 71 with respect to the intermediate transfer belt 33. To deal with the concern, in the invention as illustrated in FIGS. 2A, 4A, 5A, 6A, 7A, 9A, 10A, 11, 12A and the like, the receiving part 39 is directly formed to the support frame 40, so that the mounting precision of the receiving part 39 can be canceled. In addition, the support frame 40 supports the intermediate transfer belt 33 via the drive roller 31 and the driven roller 32. With the structure above, the precision in the mounting of the guide member 71 to the intermediate transfer belt 33 can be improved, thereby enabling to prevent image disturbance due to the electrical discharge.

Specifically, tolerance of the gap between the intermediate transfer belt 33 and the positioned guide member 71 is affected by each tolerance of a distance between an interior surface of the support frame 40 being an engagement surface of the bearing and the support frame 40 to the positioning part 38*c*; an external diameter of the drive roller 31; and the thickness of the intermediate transfer belt 33. In this case, because the tolerance of the gap has no relation to the mounting precision of the receiving part 39, the above effect can obtained.

When as in the guide unit 70 as described above, the guide member 71 disposed on the housing 7 is positioned by the receiving part 39 disposed on the apparatus body, securing an introducing and evacuating path of the guide member 71 necessary to introduce or evacuate the guide member 71 to and from the positioning part 38*c* is difficult. However, because the guide member 71 is rotatably attached to the housing 7 and a back and forth slidable movement between the guide member 71 and the housing 7 is allowed, flexibility of the posture of the guide member 71 with respect to the housing 7 is improved. With this structure, even in a state in which the guide member 71 contacts the guide surfaces 38*a* and 38*b* during the rotatable movement of the housing 7 and butting occurs, arbitrary change of the posture between the housing 7 and the guide member 71 may eliminate the butting, thereby enabling the housing 7 to open and close smoothly.

In the closed state of the housing 7 as illustrated in FIGS. 2A and 2B, if the support shaft 71*c* exists at an end of the slidable range S, the slidable movement of the support shaft 71*c* to one direction is prevented and the change in the posture of the guide member 71 with respect to the housing 7 is restricted. Therefore, there is a possibility that the butting between the guide member 71 and the receiving part 39 occurs when the housing 7 is switched from the closed state to the open state. However, because the guide member 70 is configured such that the second rotation center $O_2$ is positioned within the slidable range S in the closed state of the housing 7, the slidable movement of the guide member 71 is allowed between the housing 7 and the guide member 71 in both directions and the flexible posture of the guide member 71 with respect to the housing 7 is ensured. Then, the housing 7 can be opened smoothly.

As illustrated in FIGS. 4A and 4B through 7A and 7B, the guide member 70 is configured such that when the guide member 71 contacts the stopper 73, the second rotation center $O_2$ is positioned at the end of the slidable range S. In this case, the housing 7 rotates in a state in which the posture of the guide member 71 is held with respect to the housing 7. Accordingly, during the rotation of the housing 7, the movement locus of the guide member 71 is constant regardless whether the housing is opening or closing. Accordingly, contacts or interference of the guide member 71 with other peripheral parts (in particular, with the parts on the side of the apparatus body) can be prevented, thereby making the design of the peripheral structure easier.

In addition, because the contact portion 71*b* of the guide member 71 is disposed at a non-printing area at the front end of the guide member 71, the contact portion 71*b* of the guide member 71 can be slidably contacted in the non-printing area. Accordingly, when friction particles are generated due to the slidable contact, they do not easily attach to the recording sheet P, thereby preventing degradation of the image quality due to the deposition of the friction particles.

In the embodiment as illustrated in FIG. 2A, both the guide member 71 and the receiving part 39 are formed from resin materials so as to retard abrasion between the guide member 71 and the receiving part 39 to be concerned when both are made from different materials. It can be configured such that the body of the guide member 71 is made of a metal material and only a slidable part thereof may be attached with a cover made of resins (see FIG. 13A). To retard abrasion, the support frame 40 and the guide member 71 are preferably formed of the same material. Even if either one of the support frame 40 or the guide member 71 is formed of a metal material, the other is also preferably formed of the metal. In the example as illustrated in FIG. 2B and others, to prevent abrasion of the guide member 71 and the positioning member 38, both members are formed of a metal material. Both may be formed of a metal material but also of resins. Accordingly, the abrasion of both members can be prevented similarly.

Figure 8:
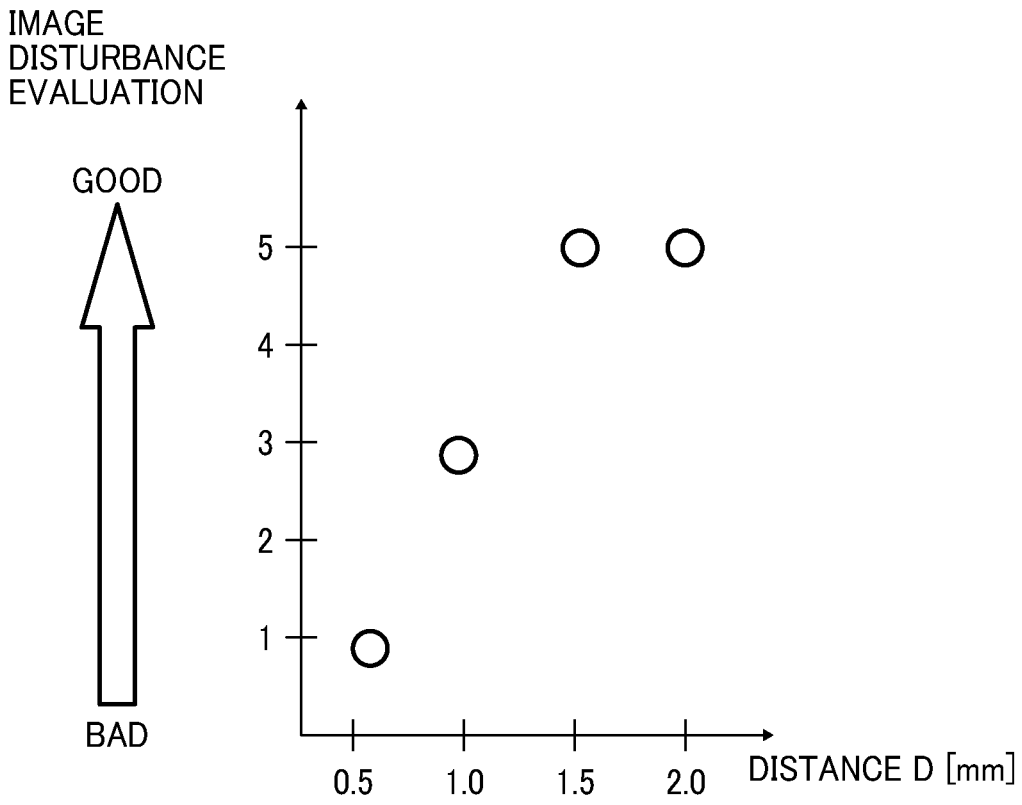
FIG. 8 is a graph showing a relation between image disturbance evaluation and distance between a contact start position of a recording medium with respect to a transfer belt and a secondary transfer nip.

It is conceivable that the size of a distance D between a position where the recording sheet P guided by the guide member 71 starts to contact the intermediate transfer belt 33 (i.e., a contact start position) and a position where the secondary transfer nip starts affects image quality. (See FIGS. 2A and 2B as to the circular arc distance on the intermediate transfer belt 33.) To verify the assumption, image formation was made varying the distance D and the image quality was evaluated for each distance D. FIG. 8 shows an evaluation result.

In FIG. 8, a vertical axis shows evaluation of the image disturbance in 5 levels and a horizontal axis shows a distance D. As the value of the vertical axis increase, occurrence of the image disturbance is lowered and image quality improves. As a result, if the distance D becomes larger, the image quality improves. Further, if the distance D of 1.5 mm or more is secured, occurrence of the image disturbance can be substantially prevented. It is therefore recommended that the guide member 71 is positioned by the positioning part 38*c* so that the distance D becomes 1.5 mm or more.

It is known that the image disturbance due to the electrical discharge tends to occur in an environmental condition of low temperature and low humidity and in a state in which the electrical resistance is high at a time of printing on a second surface in the duplex printing. When using a thick sheet as a recording sheet P for which a duplex printing is not expected, the thick sheet is not necessarily guided toward upstream in the direction of rotation of the intermediate transfer belt 33 from the secondary transfer nip. In addition, because the thick sheet P guided toward upstream exceeding the requirement receives a greater load from the guide member 71, the conveyance speed is not stabilized and there is also a problem of fluctuation in the image scaling and the density.

Accordingly, to achieve electrical discharge prevention and conveyance speed stabilization collaterally regardless of the type of the recording sheet P, it is preferred that the guide direction by the guide member 71 be made variable corresponding to the pressing force due to the rigidity of each recording sheet P.

According to the guide unit 70 as illustrated in FIGS. 2A and 2B, the guide member 71 is elastically supported by the biasing spring 72 and is slidably supported by the rotary sliding unit 75 in the direction of the biasing force F. In this case, when the high rigidity recording sheet P such as a thick sheet is conveyed through the conveyance path 5 and abuts the guide member 71, the guide member 71 that receives a pressing force B from the recording sheet P displaces in the direction of the pressing force B against the biasing force F. Herein, the pressing force B increases in proportion to a weight of the sheet. With the displacement of the guide member 71, the support shaft 71*c* of the guide member 71 moves in the direction of the pressing force B within the slot 74.

As the guide member 71 displaces, the recording sheet P with a high rigidity is guided toward a direction approaching the entrance of the secondary transfer nip than the guided direction by the guide member 71 before displacement. Accordingly, even if the recording sheet P reaches the secondary transfer nip, the recording sheet P is not greatly bent by the guide member 71, thereby reducing the conveyance load and stabilizing the conveyance speed.

In this case, when the guide member 71 is displacing, the contact portion 71*b* of the guide member 71 slides along the second guide surface 38*b* of the receiving part 39. With this structure, the position of the contact portion 71*b* of the guide member 71 can be controlled and the guided direction of the recording sheet P does not become unstable even though the guide member 71 displaces as described above.

On the other hand, in a case in which the recording sheet P with a low rigidity such as a thin paper is conveyed, the guide member 71 does not displace. As illustrated in FIGS. 7A and 7B, the recording sheet P with a low rigidity is guided toward upstream in the rotation direction of the intermediate transfer belt 33 than the electrical discharge area between the drive roller 31 and the secondary transfer roller 36 and strikes in the secondary transfer nip winding around the external surface of the intermediate transfer belt 33 after contacting the intermediate transfer belt 33. Accordingly, the image disturbance due to electrical discharge does not easily occur even in a state where the electrical resistance is high at a time of printing on a second surface in the duplex printing.

To ensure the above operation, as to the recording sheet P (thin paper) for the duplex printing, the biasing force F of the biasing spring 72 is to be stronger than the pressing force B of the recording sheet P. Specifically, assuming that the biasing force of the biasing spring 72 is set to F and the pressing force of the sheet with a maximum weight, among the recording sheet P specified to be applicable to the duplex printing, applied to the guide member 71 is set to Fa, a relation of $Fa \leq F$ should be realized. By contrast, as to the recording sheet P (thick paper) not compatible to the duplex printing, the pressing force B should be stronger than the biasing force F. Specifically, assuming that the pressing force of the recording sheet P incompatible with the duplex printing is set to Fb, a relation of $F \leq Fb$ should be realized.

As described above, by setting the biasing force F of the biasing spring 72 so as to satisfy the relation $Fa \leq F \leq Fb$, a self-correction function to automatically correct the position of the guide member 71 itself in accordance with the difference of the rigidity of the recording sheet P to be conveyed is applied to the guide member 71. With this structure, image disturbance due to the electrical discharge can be prevented for the relatively thin recording sheet P. Further, image formation with a stable conveyance speed is realized for the thick recording sheet P, thereby preventing fluctuations of the image scaling and density. Accordingly, the electrical discharge prevention and the conveyance speed stabilization can be realized collaterally.

Figure 9A:
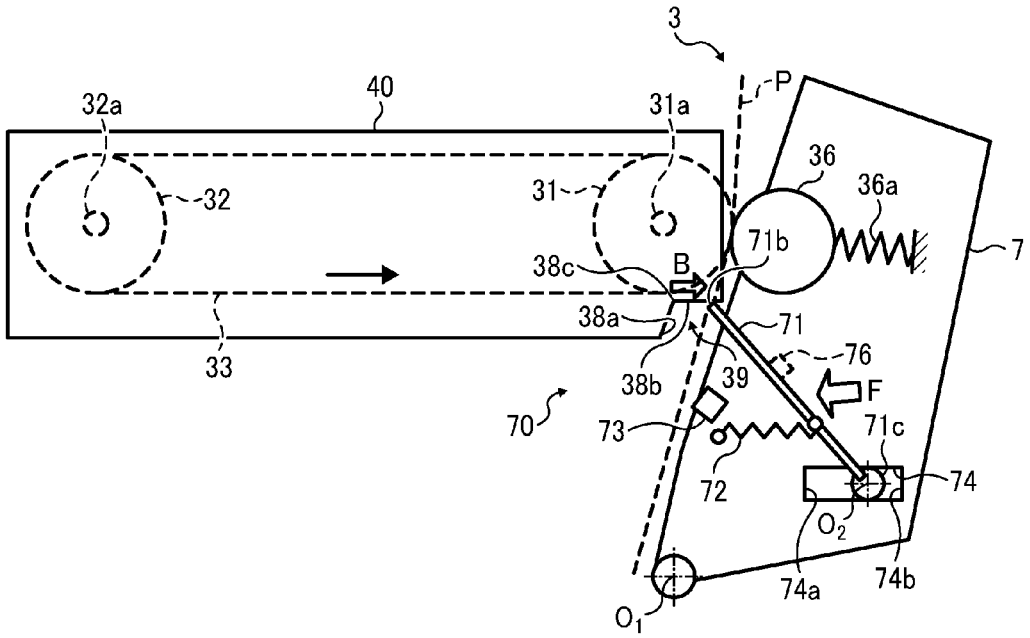
FIGS. 9A and 9B each are a side view illustrating the guide member in the housing when a thick sheet is conveyed.
Figure 9B:
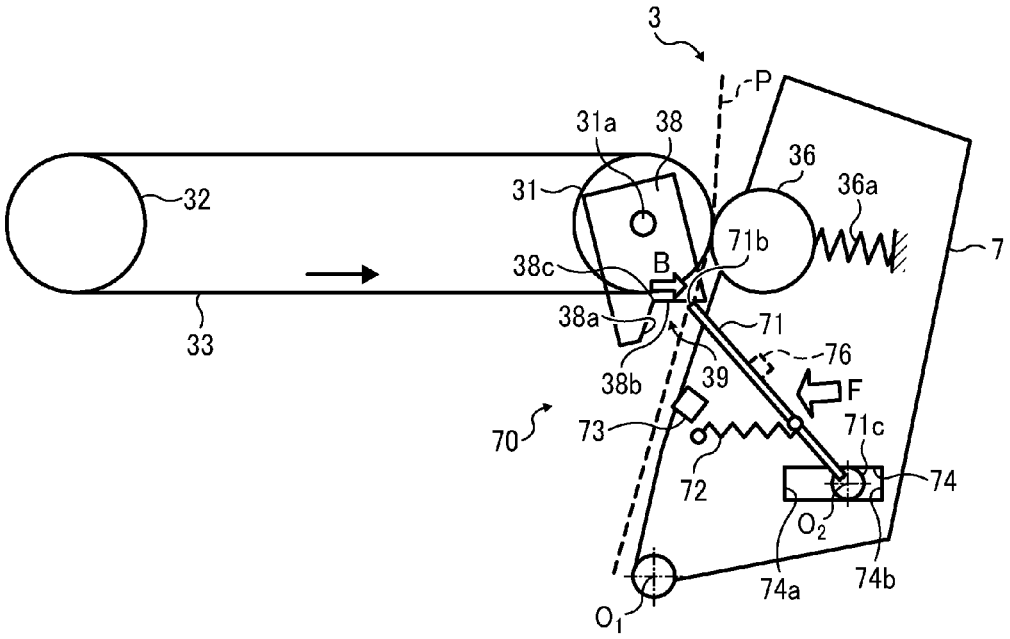

In addition, a stopper 76 regulating the maximum displacement of the guide member 71 displaced by a contact with the recording sheet P may be disposed on the housing 7 (or on a member at a side of the apparatus body) as illustrated by a broken line in FIGS. 9A and 9B. Thus, the stopper 76 prevents the guide member 71 from forwarding to the secondary transfer roller 36 exceeding the entrance to the secondary transfer nip.

Figure 18:
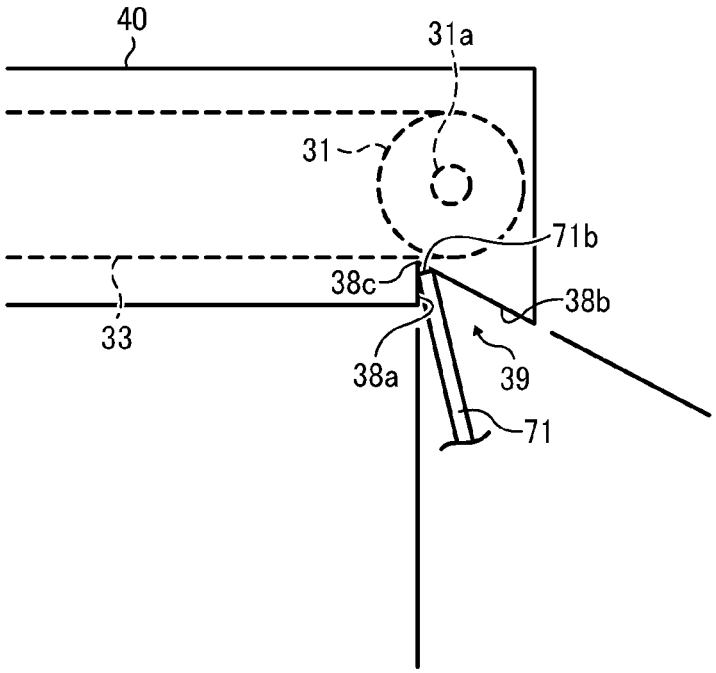
FIG. 18 is a side view illustrating a receiving part in another exemplary structure.
Figure 19:
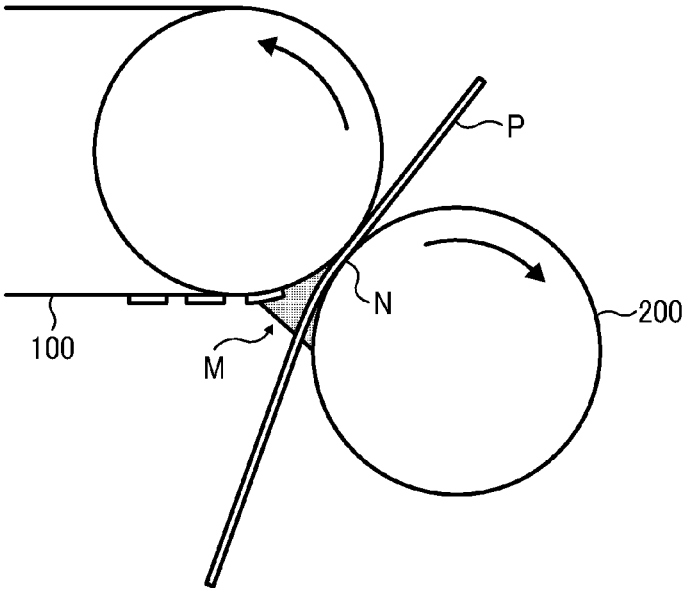
FIG. 19 RELATED ART
FIG. 19 is a side view of a conventional transfer device illustrating a general configuration thereof.

If alteration of the sheet guide direction by the guide member 71 in conveying the thick sheet is not necessary, the intersecting angle ($\theta 1+\theta 2$) formed between the first guide surface 38*a* and the second guide surface 38*b* of the receiving part 39 can be acute as illustrated in FIG. 18. Accordingly, the positioning effect of the guide member 71 with respect to the positioning part 38*c* is improved, thereby enabling to position the guide member 71 with a higher precision. In this case, even if the elastic force of the biasing spring 72 is lowered compared to the embodiment as illustrated in FIG. 2, a sufficient effect can be obtained.

Hereinafter, another embodiment of the present invention will now be described.

Figure 10A:
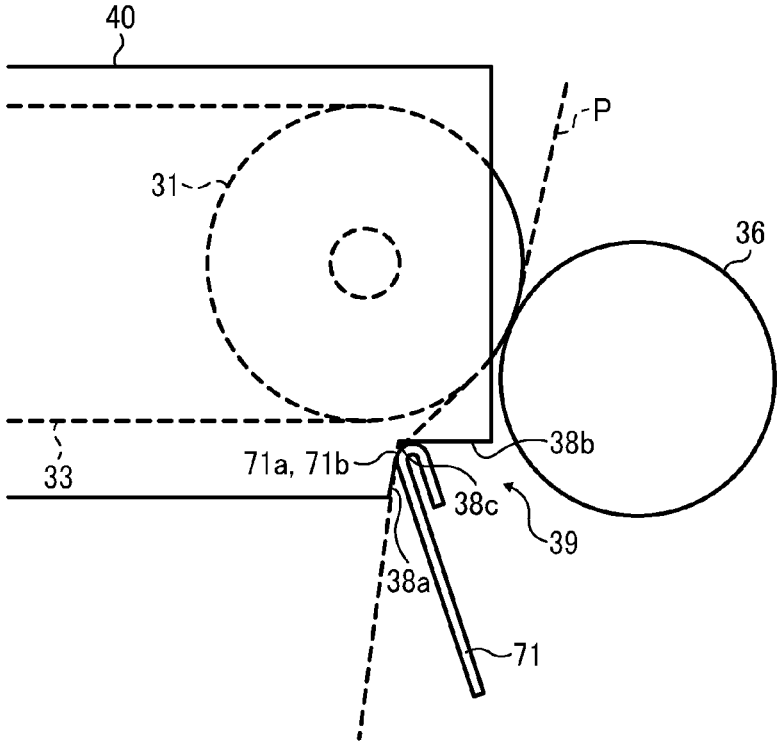
FIGS. 10A and 10B each are a side view illustrating the guide member having further another exemplary structure.
Figure 10B:
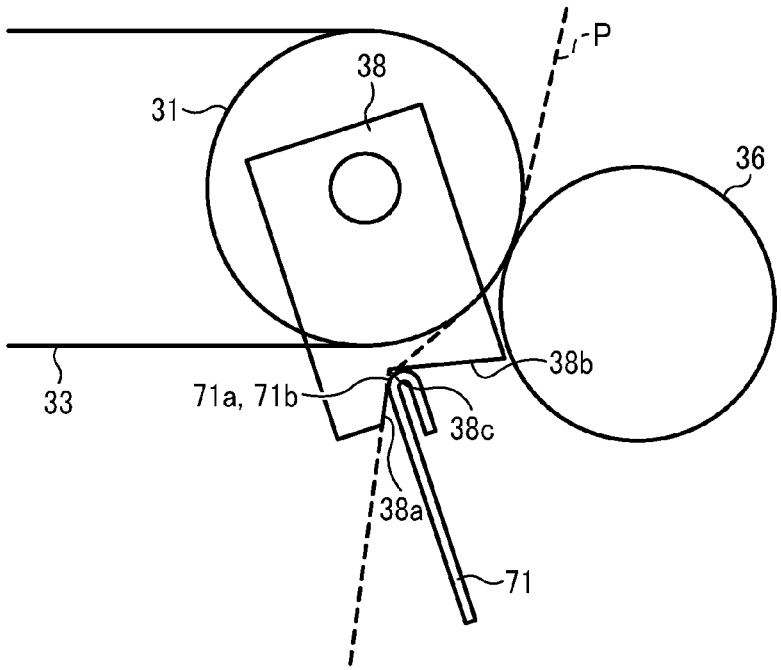

When the guide member 71 is formed of a metal, the guide member 71 is formed from the metal plate (with a thickness of from 0.8 to 1.5 mm) which is subjected to the press working. In this case, when the guide member 71 contacting the recording sheet P is bent, the guiding function of the guide portion 71*a* is not stable in the shaft direction, thereby degrading the image quality. To prevent this, as illustrated in FIGS. 10A and 10B, a front end of the guide member 71, in particular, the guide portion 71*a* is machined into a round shape, for example, to increase the rigidity of the guide portion 71*a*. If necessary, the contact portion 71*b* as well as the guide portion 71*a* may be bent. If the contact portion 71*b* is remained as a sheared surface in the press work, burr of the sheared surface may cause abrasion of the receiving part 39 to be promoted. By contrast, when the contact portion 71*b* is formed into a round shape, such a disadvantage as described above can be prevented.

Figure 11:
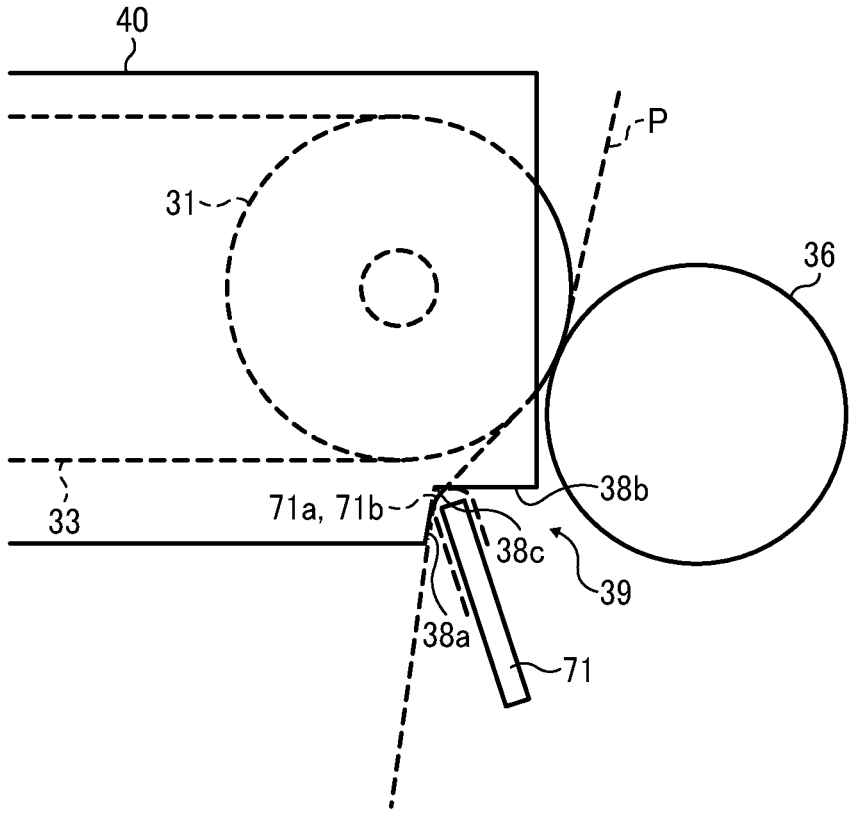
FIG. 11 is a side view illustrating the guide member having still further another exemplary structure.

Further, the guide portion 71*a* and the contact portion 71*b* at a front end of the guide member 71 may be subjected to lower friction treatment (as indicated by a broken line) such as a fluorine resin coating as illustrated in FIG. 11. Accordingly, friction between the guide portion 71*a* and the recording sheet P can be decreased, and further, because the contact portion 71*b* and the receiving part 39 contact smoothly, slidability is improved, thereby minimizing abrasion between the two parts.

Figure 12A:
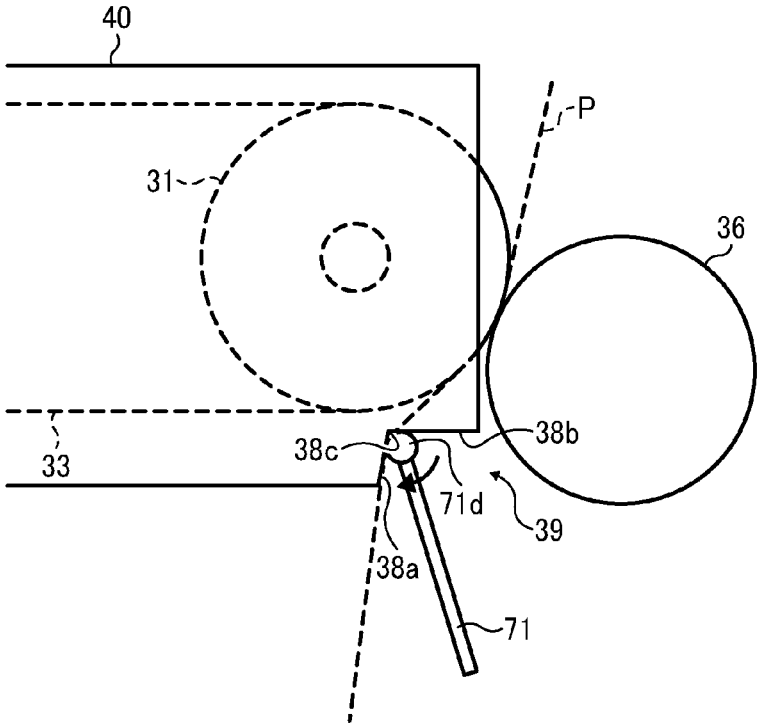
FIGS. 12A and 12B each are a side view illustrating the guide member having further another exemplary structure.
Figure 12B:
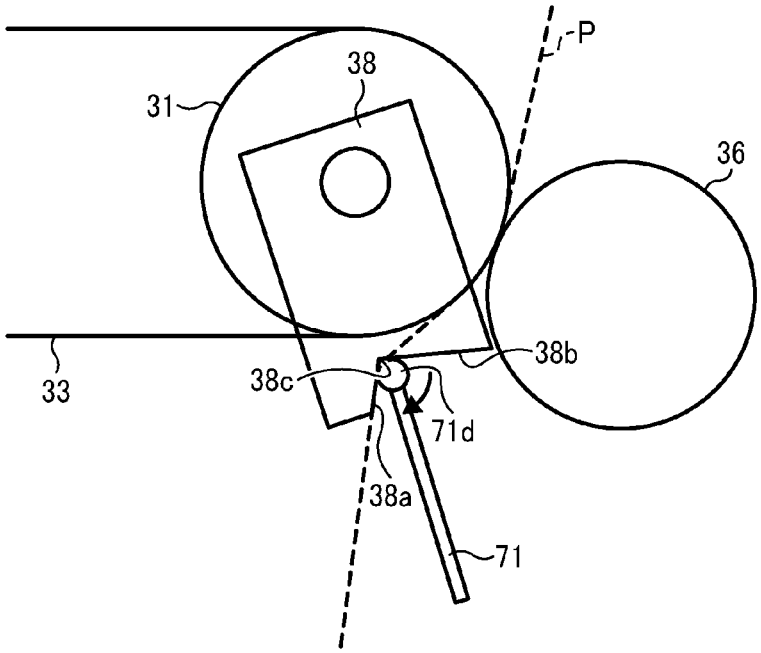

The guide portion 71*a* of the guide member 71 can be formed by a roller 71*d* as illustrated in FIGS. 12A and 12B. With this structure, the sliding load between the guide member 71 and the recording sheet P can be reduced and the recording sheet P can be conveyed to the secondary transfer nip stably.

Figure 13A:
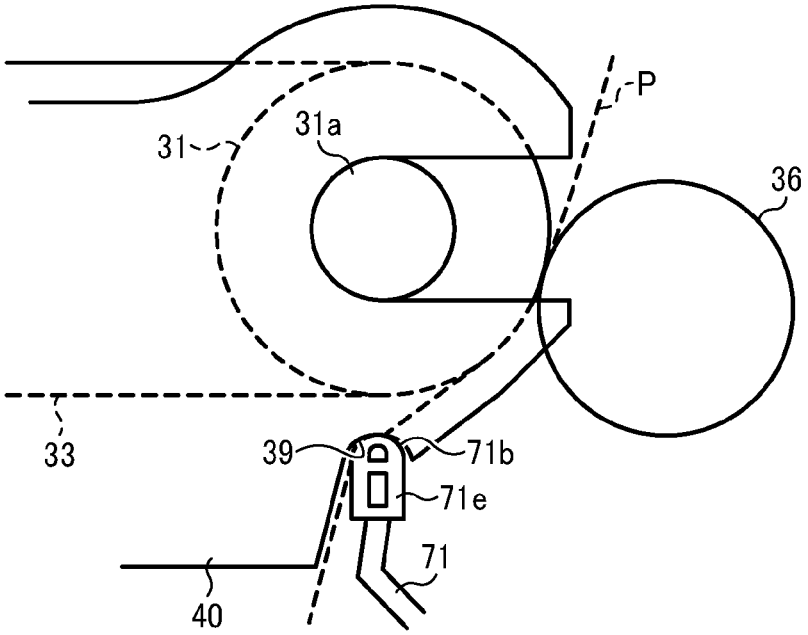
FIG. 13A is a side view illustrating the guide member having another structure and FIG. 13B is an enlarged view of a part in FIG. 13A.
Figure 13B:
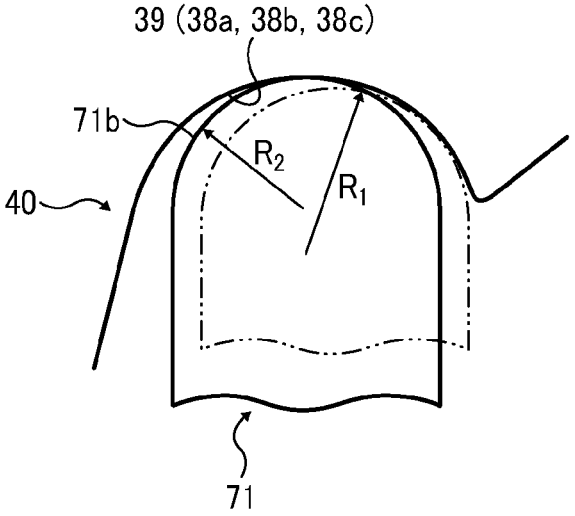

In an embodiment as illustrated in FIGS. 13A and 13B, the contact portion 71*b* of the guide member 71 and the receiving part 39 configured to position the guide member 71 each are formed into a curved surface (or a cylindrical surface), convex in the case of the former and concave in the case of the latter. In this case, the curvature radius $R_1$ of the receiving part 39 is made greater than the curvature radius $R_2$ of the guide member 71.

The convex-surface-shaped contact portion 71*b* of the guide member 71 is covered by a resin-made cover 71*e* at both ends of the front end of the guide member 71 in the axial direction. In the present embodiments, the guide portion 71*a* of the guide member 71 is machined (not shown) as illustrated in FIGS. 10A and 10B.

In the present embodiment, similarly to the embodiment as illustrated in FIG. 2A, the concave-surface-shaped receiving part 39 is integrated into the resin-made support frame 40 configured to rotatably support the drive roller 31 and the driven roller 32. With such a structure, the mounting precision of the receiving part 39 is canceled and the precision in the mounting of the guide member 71 to the intermediate transfer belt 33 is improved, thereby enabling prevention of the image disturbance due to the electrical discharge. On the other hand, as illustrated in FIG. 2B, when the receiving part 39 is formed to any member other than the support frame 40 (for example, the positioning member 38), the mounting precision of the other member with respect to the apparatus body member affects the mounting precision of the guide member 71 by the receiving part 39. In this case, cumulative errors may reduce the positional precision of the guide member 71 with respect to the intermediate transfer belt 33. To cope with this, if the receiving part 39 is directly formed to the support frame 40 to support the intermediate transfer belt 33, the mounting precision of the receiving part 39 is canceled and the precision in the mounting of the guide member 71 to the intermediate transfer belt 33 is improved, thereby enabling prevention of the image disturbance due to the electrical discharge.

The support frame 40 when the receiving part 39 is formed to the positioning member 38 is preferably formed of resin materials similarly to the case of the cover 71*e* serving as a contact portion 71*b*. In this case, the whole part of the guide member 71 can be formed of a metal material excluding the cover 71*e*. The cover 71*e* can be formed of a metal material. In this case, the support frame 40 is also formed of the metal material.

Excluding the structure as described above, in the embodiment as illustrated in FIGS. 13A and 13B, the guide unit 70 similar to the one in the embodiment as illustrated in FIGS. 2A and 2B is disposed. Accordingly, similar to the embodiment as illustrated in FIGS. 2A and 2B, in the open state of the housing 7, the guide member 71 is pressed against the receiving part 39 by the biasing force F of the biasing spring 72 and positioning of the guide member 71 is performed. FIG. 13B is an enlarged view of a part in FIG. 13A. In addition, with the opening/closing of the housing 7, the guide member 71 slidably moves sliding along an interior surface of the receiving part 39 similarly to the aspect as illustrated in FIGS. 3A to 3C through 7A and 7B. Because the receiving part 39 and the contact portion 71*b* each are formed into a curved surface, butting during the slidably moving of both parts does not occur easily and the housing 7 can be opened and closed smoothly.

When the guide member 71 contacts the high rigidity recording sheet P such as a thick sheet, the guide member 71 that receives a pressing force from the recording sheet P slides along the receiving part 39 and displaces in the slidable movement direction of the guide unit 70 as illustrated by a broken line in FIG. 13B. (At this time, the support shaft 71*c* also moves in the same direction along the slot 74.) As a result, the recording sheet P is guided to approach the entrance of the secondary transfer nip than the guided direction by the guide member 71 before displacement. Accordingly, even if the recording sheet P with a higher rigidity reaches the secondary transfer nip, the recording sheet P is not greatly bent by the guide member 71, thereby reducing the conveyance load and stabilizing the conveyance speed.

Boundaries between the guide surfaces 38*a* and 38*b* and the positioning part 38*c* in the curved-surface receiving part 39 are not definite, differently from the V-shaped receiving part 39 in the embodiment as illustrated in FIGS. 2A and 2B. However, as apparent from the description heretofore, the curved-surface receiving part 39 also includes each part 38*a*, 38*b*, and 38*c*, and functions similarly.

Figure 14:
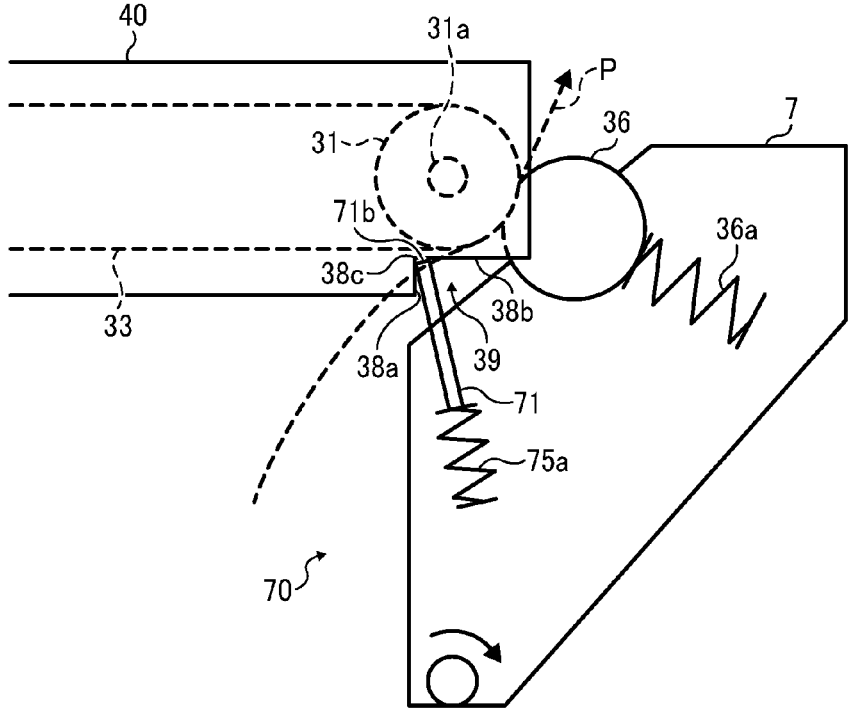
FIG. 14 is a side view illustrating a general structure of the guide member in a housing and a transfer device according to another embodiment of the present invention.

Next, a description will be given of further another embodiment of the present invention referring to FIGS. 14 to 17. FIG. 14 is a side view illustrating a general structure of a part around the secondary transfer nip according to another embodiment of the present invention.

In the embodiment as illustrated in FIG. 14, the guide unit 70 does not include the rotary sliding unit 75 which allows a relative rotary movement and back-and-forth sliding movement between the guide member 71 and the housing 7 among components as illustrated in FIG. 2A. Instead of the rotary sliding unit 75, the guide member 71 is supported by the housing 7 via a supporting and biasing spring 75*a* as a biasing means, which is different from the embodiment as illustrated in FIG. 2A. Duplicated explanation of the structure which is common to the structure in FIG. 2A will be omitted and different points will now be mainly described.

The supporting and biasing spring 75*a* is a compression spring disposed between the housing 7 and the guide member 71 and biases constantly the guide member 71 from its base end to the front end. In a closed state of the housing 7, the contact portion 71*b* of the guide member 71 contacts the positioning part 38*c* of the receiving part 39 and the contact portion 71*b* is positioned at the positioning part 38*c* by the biasing force of the supporting and biasing spring 75*a*. As a result, the recording medium P contacting the guide member 71 is guided by the guide member 71 toward upstream in the rotation direction of the intermediate transfer belt 33 than the secondary transfer nip and the degradation of the image quality by the electrical discharge can be prevented.

When the housing 7 is opened from the state as illustrated in FIG. 14, the contact portion 71*b* of the guide member 71 is separated from the receiving part 39 while sliding along the second guide surface 38*b*. When the housing 7 is closed, the contact portion 71*b* of the guide member 71 slidably moves along the second guide surface 38*b* and reaches the positioning part 38*c* and is positioned. After the guide member 71 contacts the receiving part 39, the supporting and biasing spring 75*a* is compressed according to the rotation of the housing 7 in the closing direction until the housing 7 is completely closed. Accordingly, in the completely closed state of the housing 7, the guide member 71 is positioned at the positioning part 38*c* by the biasing force of the supporting and biasing spring 75*a*.

In such a structure, when the housing 7 is opened and the contact portion 71*b* is separated from the contact portion 71*b*, the guide member 71 flies out toward the direction biased by the supporting and biasing spring 75*a* and contacts the intermediate transfer belt 33, which may cause the intermediate transfer belt 33 to be damaged.

Figure 15:
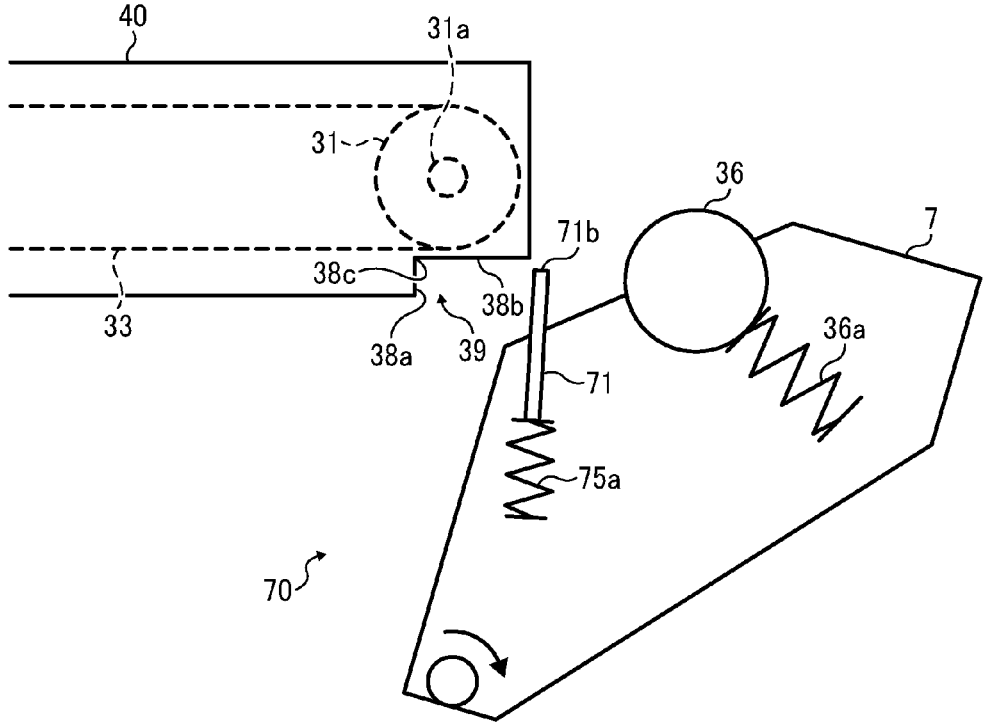
FIG. 15 is a side view illustrating the guide member in the housing open state.

To prevent such an adverse occasion, it is recommended as illustrated in FIGS. 14 and 15 that the end of the support frame 40 facing the housing 7 is extended to a position exceeding the intermediate transfer belt 33 and the drive roller 31. With this structure, even when the guide member 71 separated from the receiving part 39 flies out by the biasing force, the guide member 71 does not contact the intermediate transfer belt 33, thereby preventing damages to the intermediate transfer belt 33.

If the flying out of the guide member 71 occurs excessively by the biasing force, the guide member 71 interferes with the edge surface of the support frame 40 when the housing 7 is closed from the open state and it may occur that the guide member 71 is not guided to the receiving part 39. To prevent this, it is preferred that a stopper to prevent the guide member 71 from flying out be disposed between the guide member 71 and the housing 7.

Figure 16A:
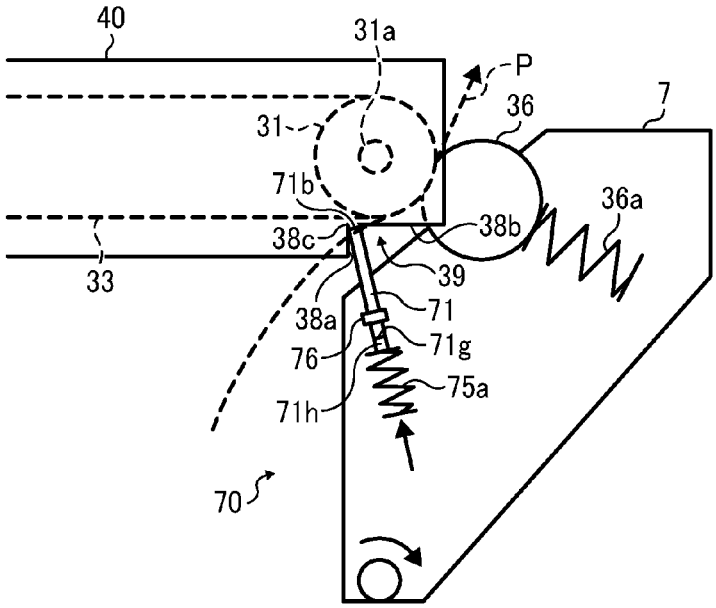
FIGS. 16A and 16B are side views illustrating another configuration of the guide member and a regulation member and FIG. 16C is an oblique view illustrating a part of FIGS. 16A and 16B.
Figure 16B:
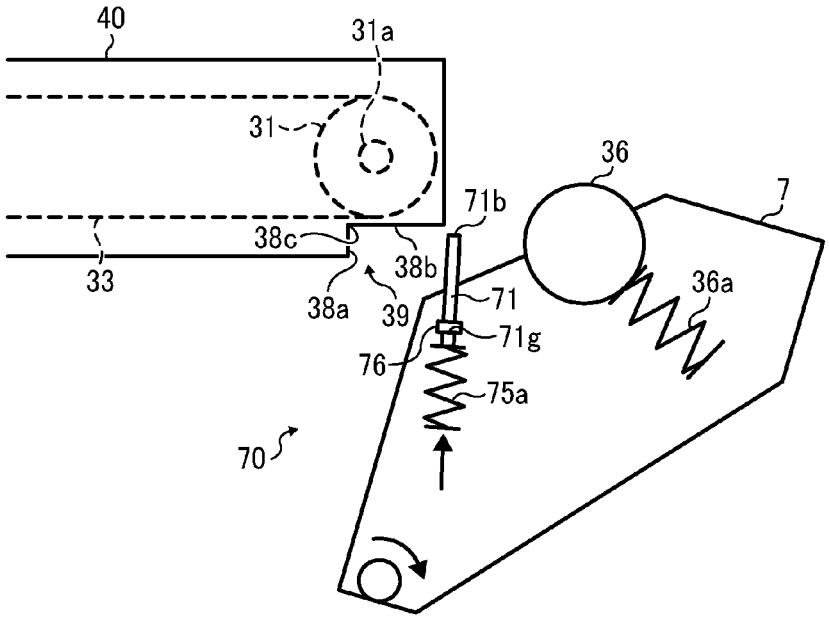
Figure 16C:
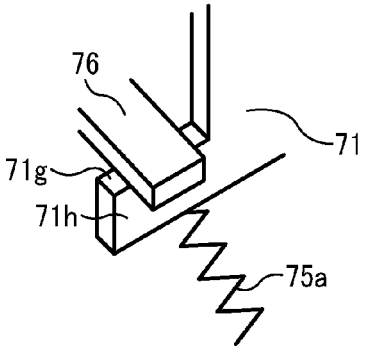
Figure 17:
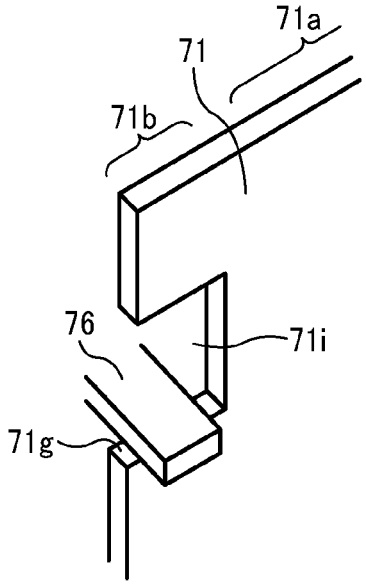
FIG. 17 is an oblique view of the guide member and the regulation member illustrating another exemplary structure.

FIGS. 16A to 16C shows an example of the stopper 76 disposed to the housing 7. As illustrated in FIGS. 16A to 16C, the guide member 71 includes an engagement part 71*g* capable of engaging with the stopper 76 in the biasing direction of the supporting and biasing spring 75*a*. The guide member 71 includes the engagement part 71*g* which is formed with a protruding portion 71*h* as illustrated in FIG. 16C. The engagement part 71*g* can also be configured such that a cutout portion 71*i* is formed to the guide member 71.

With these structures, even in a case where the guide member 71 is separated from the receiving part 39 and flies out due to the biasing force of the supporting and biasing spring 75*a*, flying out of the guide member 71 is prevented by the contact of the engagement part 71*g* with the stopper 76, and the overstrike of the guide member 71 as illustrated in FIG. 16B can be prevented. Accordingly, when the housing 7 is closed, the guide member 71 does not interfere with the support frame 40 or the intermediate transfer belt 33, thereby closing the housing 7 smoothly.

The image forming apparatus according to the embodiments of the present invention may also be applied to the monochrome image forming apparatus, any other type of copier, printer, facsimile machine, or the multifunction apparatus combining the functions of the above devices.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a rotatable transfer member configured to carry a toner image thereon;

a rotary transfer member to form a transfer nip for transferring the toner image on the transfer member to a recording medium while pressing against the rotatable transfer member;

a housing rotatable about a first rotation center together with the rotary transfer member between a closed state to form the transfer nip and an open state eliminating the transfer nip by the rotation about the first rotation center;

a guide member, pivotally fixed to the housing at one end of the guide member such that the guide member pivots relative to the housing, to guide the recording medium conveyed through a conveyance path upstream in a direction of rotation of the rotatable transfer member;

a support frame to support the rotatable transfer member;

a biasing member to bias the guide member in a direction; and a receiving part formed on a surface of the support frame and configured to contact the guide member biased by the biasing member and position the guide member in the closed state of the housing, wherein the receiving part comprises a positioning part to position the guide member; and a guide surface along which the guide member slidably displaces during opening/closing of the housing is on the receiving part.

2. The image forming apparatus as claimed in claim 1, wherein the housing is provided with a slot formed as a through hole in a wall of the housing, the image forming apparatus further comprising a rotary sliding unit allowing a rotary movement about a second rotation center and a reciprocal sliding movement over a range of the slot.

3. The image forming apparatus as claimed in claim 1, wherein a contact portion of the guide member that contacts the receiving part is a curved surface.

4. The image forming apparatus as claimed in claim 1, wherein the guide member is made of sheet metal and a contact portion of the guide member that contacts the receiving part has a round shape.

5. The image forming apparatus as claimed in claim 1, wherein the receiving part is a curved surface.

6. The image forming apparatus as claimed in claim 1, wherein an end of the support frame extends beyond the rotary transfer member.

7. The image forming apparatus as claimed in claim 1, further comprising a stopper provided on the housing to prevent the guide member from displacing in the direction in which the guide member is biased by the biasing member.

8. An image forming apparatus comprising:

a rotatable transfer member configured to carry a toner image thereon;

a rotary transfer member to form a transfer nip for transferring the toner image on the rotatable transfer member to a recording medium while pressing against the rotatable transfer member;

a support frame that supports the rotatable transfer member;

a housing rotatable about a first rotation center together with the rotary transfer member between a closed state to form the transfer nip and an open state eliminating the transfer nip by the rotation about the first rotation center;

a guide member that extends between the support frame and the housing to guide the recording medium conveyed through a conveyance path upstream in the direction of rotation of the rotatable transfer member;

a rotary sliding unit fitted within a slot of the housing and configured to allow a rotary movement of the guide member about a second rotation center and a reciprocal sliding movement of an end of the guide member in the slot of the housing, such that the guide member is movable relative to the housing;

a biasing member to bias the guide member in a direction; and a receiving part formed on a surface of the support frame and configured to contact the guide member biased by the biasing member and position the guide member in the closed state of the housing.

9. The image forming apparatus as claimed in claim 8, wherein the second rotary center is disposed within the slot in the closed state of the housing.

10. The image forming apparatus as claimed in claim 8, further comprising a stopper provided on the housing, wherein the stopper does not contact the guide member with the housing in the closed state and contacts the guide member biased in the direction by the biasing member when the housing switches from the closed state to the open state, and wherein the second rotary center is positioned at an end of the slidable range by the biasing member when the guide member contacts the stopper.

11. The image forming apparatus as claimed in claim 8, wherein displacement of the guide member varies depending on a pressing force with which the recording medium presses against the biasing force of the biasing member.

12. The image forming apparatus as claimed in claim 11, wherein the biasing force is set so that the guide member is positioned in place by the receiving part when the recording medium with a low rigidity contacts the guide member and the guide member is displaced by the pressing force of the recording medium against the biasing force of the biasing member when the recording medium with a high rigidity contacts the guide member.

13. The image forming apparatus as claimed in claim 8, wherein the receiving part includes a guide surface along which the guide member displaced by contact with the recording medium slidably moves.

14. The image forming apparatus as claimed in claim 8, wherein the guide member contacts the receiving part at a non-printing area.

15. The image forming apparatus as claimed in claim 8, wherein an end of the guide member contacting the receiving part comprises a curved surface.

16. The image forming apparatus as claimed in claim 8, wherein both the receiving part and the guide member are formed of one of a metal material and a resin material.

17. The image forming apparatus of claim 1, wherein the biasing member is between the guide member and the housing.

18. The image forming apparatus of claim 8, wherein the biasing member is between the guide member and the housing.

19. An image forming apparatus comprising:

a transfer belt;

a transfer roller to form a transfer nip between the transfer belt and the transfer roller;

a support frame that supports the transfer belt;

a housing to support the transfer roller and rotatable about a first rotation center between a closed state to form the transfer nip and an open state eliminating the transfer nip;

a guide member to guide a sheet conveyed toward the transfer nip; and a receiving part formed on a surface of the support frame to contact and position the guide member in the closed state of the housing, wherein a slot is formed in a wall of the housing, the guide member includes a shaft supported within the slot, and the shaft reciprocally slides within the slot when the housing rotates, such that the guide member is movable relative to the housing.

20. The image forming apparatus as claimed in claim 19, wherein the slot includes two edges, and the shaft does not contact the two edges in the closed state of the housing.

21. The image forming apparatus as claimed in claim 19, wherein the slot includes two edges, and the shaft contacts one of the two edges in the open state of the housing.

22. The image forming apparatus as claimed in claim 19, wherein the shaft is configured to slide on the slot from a stress from the receiving part to the guide member.

23. The image forming apparatus as claimed in claim 19, further comprising:

a plurality of support rollers to support the transfer belt; and a frame to support the plurality of support rollers, wherein the receiving part is formed on the frame.

24. The image forming apparatus as claimed in claim 19, further comprising:

a support roller to support the transfer belt and facing the transfer nip; and a positioning member at an end of the support roller, wherein the receiving part is on the positioning member.

25. The image forming apparatus as claimed in claim 19, wherein the guide member includes metal.

* * * * *